US010547961B2

(12) United States Patent
Kitazawa et al.

(10) Patent No.: US 10,547,961 B2
(45) Date of Patent: Jan. 28, 2020

(54) SIGNAL PROCESSING APPARATUS, SIGNAL PROCESSING METHOD, AND STORAGE MEDIUM

(71) Applicant: CANON KABUSHIKI KAISHA, Tokyo (JP)

(72) Inventors: Kyohei Kitazawa, Kawasaki (JP); Noriaki Tawada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/729,416

(22) Filed: Oct. 10, 2017

(65) Prior Publication Data

US 2018/0115852 A1 Apr. 26, 2018

(30) Foreign Application Priority Data

Oct. 25, 2016 (JP) ..... 2016-208845
Oct. 31, 2016 (JP) ..... 2016-213524

(51) Int. Cl.

| | |
|---|---|
| ***H04R 3/00*** | (2006.01) |
| ***H04S 7/00*** | (2006.01) |
| ***G10L 19/02*** | (2013.01) |
| *H04R 1/02* | (2006.01) |
| *H04R 29/00* | (2006.01) |

(52) U.S. Cl.
CPC ..... *H04S 7/303* (2013.01); *G10L 19/0204* (2013.01); *H04R 29/005* (2013.01)

(58) Field of Classification Search
CPC ..... H04S 7/303; G10L 19/0204; G10L 2021/02166; H04R 3/005; H04R 29/005; H04R 2430/20; H04R 1/26
USPC ..... 381/92, 91
See application file for complete search history.

(56) References Cited

U.S. PATENT DOCUMENTS

2007/0223732 A1* 9/2007 Mao ..... G10L 21/0208 381/92
2010/0026809 A1* 2/2010 Curry ..... H04N 5/222 348/157
2015/0117672 A1* 4/2015 Christoph ..... H04R 3/005 381/92

FOREIGN PATENT DOCUMENTS

JP 2014-72708 A 4/2014
JP 2014-175996 A 9/2014

* cited by examiner

*Primary Examiner* — Vivian C Chin
*Assistant Examiner* — Ammar T Hamid
(74) *Attorney, Agent, or Firm* — Canon U.S.A., Inc. IP Division

(57) ABSTRACT

A signal processing apparatus includes: an acquisition unit configured to acquire a sound collection signal based on collection of sounds in a sound collection target region by a plurality of microphones; an identification unit configured to identify a position or a region corresponding to an object in the sound collection target region; and a generation unit configured to generate a plurality of acoustic signals corresponding to a plurality of divided areas obtained by dividing the sound collection target region based on the identified position or the identified region, using the acquired sound collection signal.

21 Claims, 20 Drawing Sheets

NUMBER OF AREAS 64

NUMBER OF AREAS 31

SIGNAL PROCESSING APPARATUS, SIGNAL PROCESSING METHOD, AND STORAGE MEDIUM

BACKGROUND OF THE INVENTION

Field of the Invention

The aspect of the embodiments relates to a signal processing apparatus, a signal processing method, and a storage medium for processing collected acoustic signals.

Description of the Related Art

There is known a technique for dividing a space into a plurality of areas and acquiring sounds from each of the divided areas (refer to Japanese Patent Laid-Open No. 2014-72708).

There is a demand for enhancing processing efficiency in a configuration in which sounds are acquired from a plurality of areas formed by dividing a space to generate playback signals.

SUMMARY OF THE INVENTION

A signal processing apparatus includes: an acquisition unit configured to acquire a sound collection signal based on collection of sounds in a sound collection target region by a plurality of microphones; an identification unit configured to identify a position or a region corresponding to an object in the sound collection target region; and a generation unit configured to generate a plurality of acoustic signals corresponding to a plurality of divided areas obtained by dividing the sound collection target region based on the identified position or the identified region, using the acquired sound collection signal.

Further features of the disclosure will become apparent from the following description of exemplary embodiments (with reference to the attached drawings).

DESCRIPTION OF THE EMBODIMENTS

Embodiments of the disclosure will be described below with reference to the drawings. The following embodiments do not limit the disclosure, and all the combinations of characteristics described in relation to the embodiments are not necessarily required for a solution in the disclosure. The same components will be given the same reference signs.

First Embodiment

In a first embodiment, the number of divided areas to be used is decreased in the case where a sound source division process cannot be in time for real-time playback.

(Audio Signal Processing Apparatus)

Figure 1:
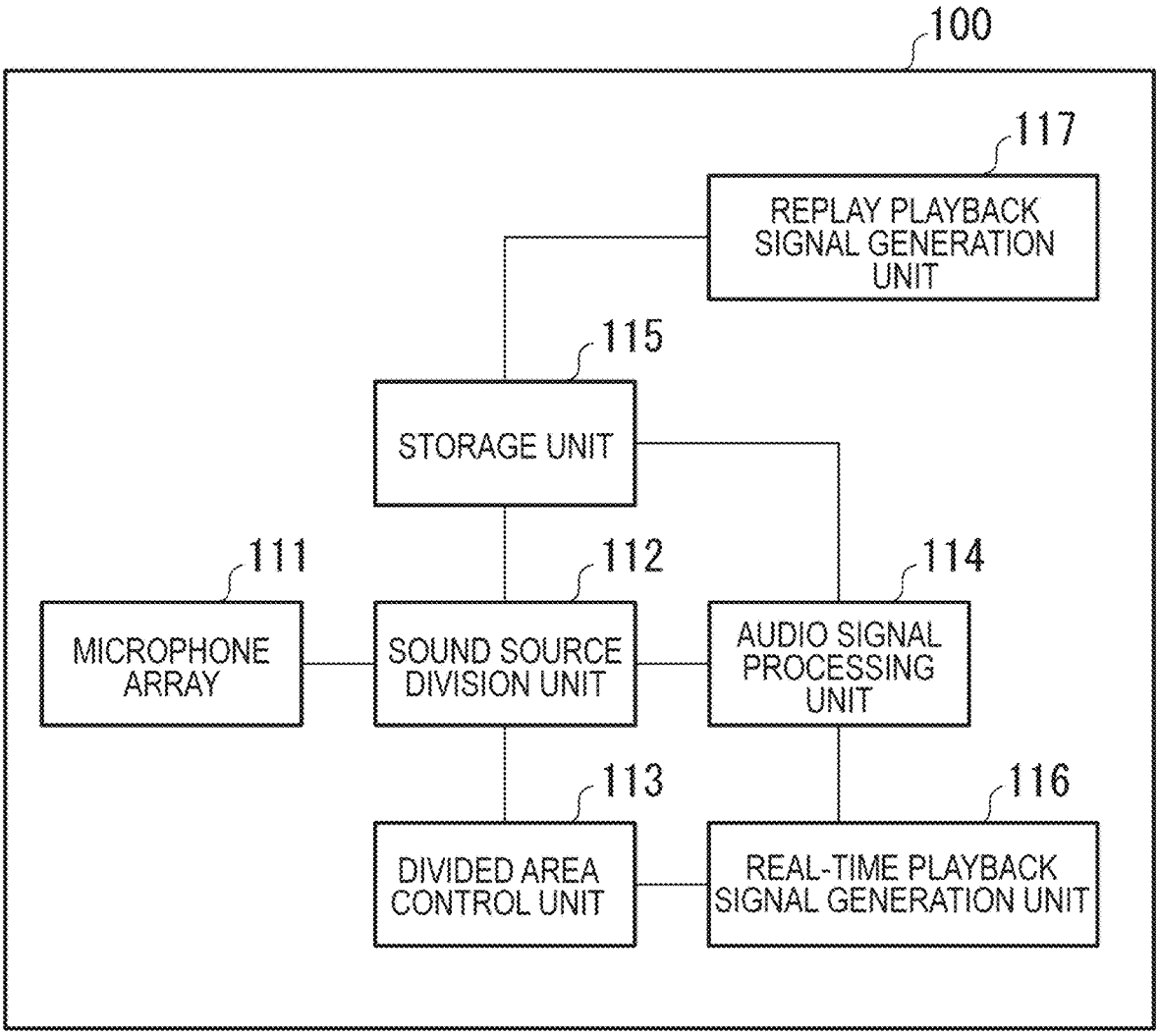
FIG. 1 is a block diagram of a configuration of an audio signal processing apparatus.

FIG. 1 is a block diagram of a configuration of an audio signal processing apparatus 100. The audio signal processing apparatus 100 collects sounds by a microphone array from a predetermined spatial area, separates the collected sounds into a plurality of audio signals based on a plurality of divided areas to perform audio processing, and generates playback signals by mixing. The audio signal processing apparatus 100 includes a microphone array 111, a sound source division unit 112, a divided area control unit 113, an audio signal processing unit 114, a storage unit 115, a real-time playback signal generation unit 116, and a replay playback signal generation unit 117.

The microphone array 111 is formed from a plurality of microphones. The microphone array 111 collects sounds by the microphones in a responsible space. Since each of the microphones constituting the microphone array 111 collects sounds, the sounds collected by the microphone array 111 become a multi-channel sound collection signal formed from the plurality of sounds collected by the microphones. The microphone array 111 collects the sounds by the microphones in the space, subjects the collected signal to analog-digital conversion (A/D conversion), and outputs the signal to the sound source division unit 112.

The sound source division unit 112, the divided area control unit 113, the audio signal processing unit 114, the real-time playback signal generation unit 116, and the replay playback signal generation unit 117 are formed from arithmetic processing units such as a central processing unit (CPU), a DSP, and an MPU, for example. DSP is an abbreviation of digital signal processor, and MPU is an abbreviation of micro-processing unit.

When the microphone array 111 divides the space responsible for sound collection into N (N>1) areas (hereinafter, called as "divided areas"), the sound source division unit 112 performs a sound source division process to divide the signal input from the microphone array 111 into respective sounds in the divided areas. As described above, the sound collection signal input from the microphone array 111 is a multi-channel signal formed from the plurality of sounds collected by the microphones. Accordingly, based on the positional relationship between each of the microphones constituting the microphone array 111 and the divided area from which to collect sounds, performing phase control on the audio signal collected by the microphone and adding a weight to the audio signal makes it possible to reproduce the sounds in arbitrary one of the divided areas. In the embodiment, a predetermined layout of the divided areas is described as an example. The sound source division unit 112 performs the sound source division process to divide the space into N (N>1) areas using the signal input from the microphone array 111. The division process is carried out in each processing frame, that is, at predetermined time intervals. For example, the sound source division unit 112 performs a beam forming process to acquire the sound in each area at predetermined time intervals. The sound source division unit 112 outputs the sound acquired by the dividing to the audio signal processing unit 114 and the storage unit 115.

Figure 2B:
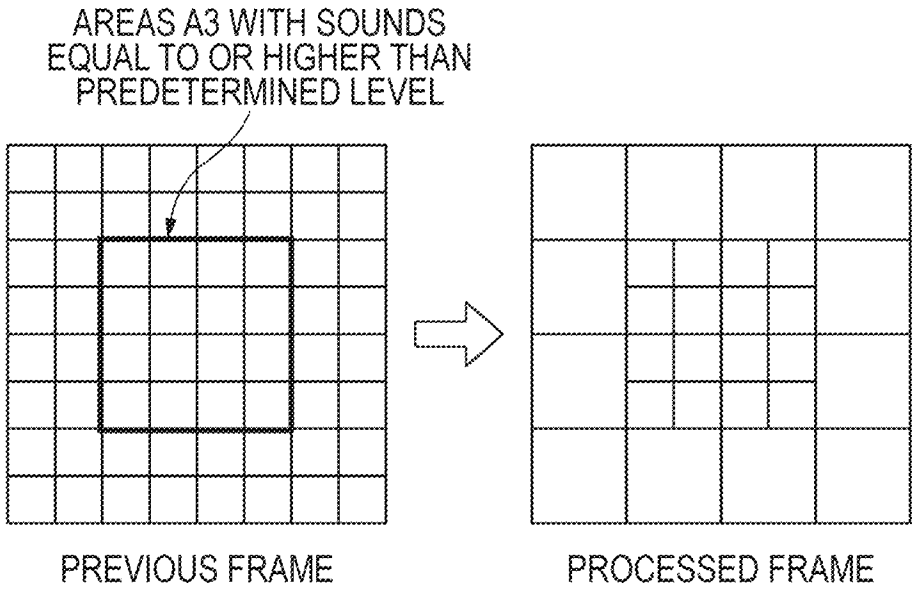
FIGS. 2A and 2B are illustrative diagrams of divided area control.
Figure 2A:
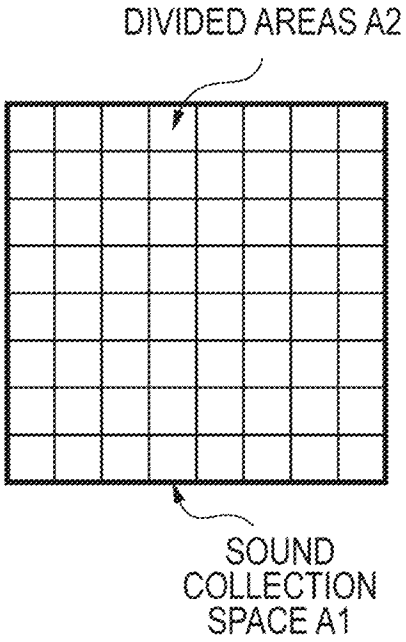

The divided area control unit 113 controls the division of a specific space where the microphone array collects sounds into the plurality of divided areas, depending on a processing load for dividing the sound sources, generating the playback signals, or the like. Specifically, the divided area control unit 113 controls the layout and number of the plurality of divided areas. For example, when the processing apparatus will not be in time for real-time playback if the processing apparatus performs the sound source division process in all the areas due to a great processing load on the processing apparatus, the divided area control unit 113 decreases the number of areas by combining the sound source areas divided by the sound source division unit 112. When the processing apparatus can perform a process sufficiently in time for real-time playback, for example, the divided area control unit 113 divides finely a sound collection space (sound collection target region) A1 to 8×8=64 areas A2 as illustrated in FIG. 2A. When the processing apparatus cannot perform a process in time for real-time playback, the divided area control unit 113 determines whether the sounds in the areas in the processing of the previous frame are equal to or higher than a predetermined level, for example, and combines the areas where the sounds are lower than the predetermined level to reduce the number of areas as illustrated in FIG. 2B. There is a high probability that the sounds at the predetermined level or higher are significant sounds and the sounds lower than the predetermined level are not significant sounds, such as noise. That is, it can be specified that there exist objects emitting sounds in the areas where the sounds at the predetermined level or higher are detected. Accordingly, assigning the fine divided areas on a priority basis to the areas with the sounds at the predetermined level or higher makes it possible to reproduce the significant sounds with high fidelity, and integrating the divided areas in the areas with the sounds lower than the predetermined level makes it possible to enhance the speed of processing.

Figure 3:
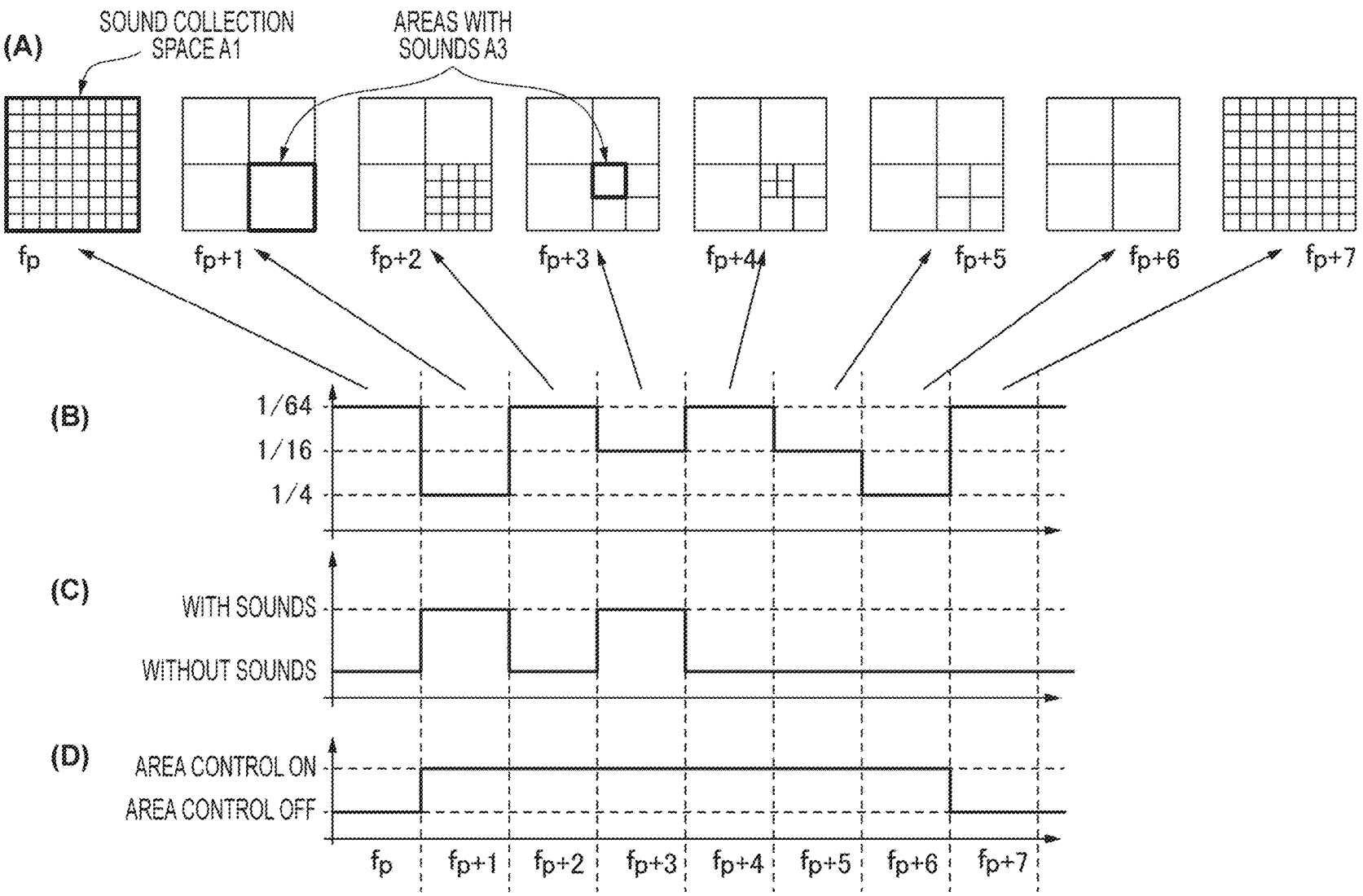
FIG. 3 is an illustrative diagram of temporal changes in divided area control.

FIG. 3 illustrates an example of changes in the area division size. (D) of FIG. 3 illustrates the state in which area control is performed (area control ON) or not (area control OFF) based on a processing load. In (D) of FIG. 3, fp to fp+7 represent frame numbers. (C) of FIG. illustrates the state in which the level of the sound divided by area is equal to or higher than the predetermined level (with sound) or is lower than the predetermined level (without sound). In (C) of FIG. 3, there are sounds in the frames fp+1 and fp+3. (B) of FIG. 3 illustrates the division size of the most finely divided areas. The division size represents the smallest area with respect to the area of the sound collection space A1 as 1. For example, in the frame fp, the space is equally divided into 64 areas and the smallest area size is 1/64. (A) of FIG. 3 illustrates the state in which each frame is divided into a plurality of areas.

In frames fp+1 to fp+6, the number of areas is to be decreased due to a great processing load. In the frame fp, the level of the sound did not exceed a predetermined value in every area (without sounds in (C) of FIG. 3). Accordingly, in the frame fp+1, the area size is large in which one side is 1/2 of the sound collection space and the sound collection space is divided into four (1/4 in (B) of FIG. 3).

In the frame fp+1, there is an area at a sound level above the predetermined value (with sound in (C) of FIG. 3). Accordingly, in the frame fp+2, the area A3 with sound is divided again into small areas in which one side is 1/8 of the sound collection space A1 (1/64 in (B) of FIG. 3).

In the frame fp+2, the sound level did not exceed the predetermined value in every area (without sound in (C) of FIG. 3). Accordingly, in the frame fp+3, some of the areas are combined so that the area is divided into middle-sized areas in which one side is 1/4 of the sound collection space (1/16 in (B) of FIG. 3).

In the frame fp+3, there is an area where the sound level exceeded the predetermined value (with sound in (C) of FIG. 3). Accordingly, in the frame fp+4, the area A3 with sound is divided again into small areas in which one side is 1/8 of the sound collection space (1/64 in (B) of FIG. 3).

In the frames fp+4 and fp+5, the sound level did not exceed the predetermined value in every area (without sound in (C) of FIG. 3). Accordingly, the areas are combined so that in the frame fp+6, the sound collection space is divided into four large areas in which one side is 1/2 of the sound collection space.

In this way, the divided area control unit 113 increases or decreases the number of divided areas depending on the presence or absence of detection of sound. In this example, the divided area control unit 113 decreases the number of areas by combining the sound source divided areas. Alternatively, the sound source division unit 112 may have beam forming filters for dividing the space into a plurality of area sizes so that the divided area control unit 113 can control the use of the filters.

Further, the divided area control unit 113 manages area information about areas combined by the divided area control in association with the frames as a divided area control list. For example, when four areas are combined in the frame fq, the frame fq and the four areas are managed in a list. In this case, the areas are given IDs or the like in advance to be distinguishable from one another. In response to decrease in the processing load, the divided area control unit 113 instructs the sound source division unit 112 to perform sound source division in each of the areas combined with the frame recorded in the divided area control list. Upon completion of the sound source division, the frame and the areas are deleted from the list.

The audio signal processing unit 114 performs audio signal processing by frame and area. The processing performed by the audio signal processing unit 114 includes, for example, a delay correction process for correcting the influence of the distance between the area and the sound collection apparatus, gain correction process, echo removal, and others.

The storage unit 115 is a storage device such as a hard disc drive (HDD), a solid-state drive (SSD), or a memory, for example. The storage unit 115 records signals in all audio channels in the frames under the divided area control by the sound source division unit 112 and signals subjected to the audio signal processing by the audio signal processing unit 114 together with time information.

The real-time playback signal generation unit 116 generates and outputs a real-time playback signal by mixing the respective sounds in the areas obtained by the sound source division unit 112 within a predetermined time from the sound collection. For example, the real-time playback signal generation unit 116 acquires externally the position of a virtual listening point and the orientation of a virtual listener in the sound collection space varying with time (hereinafter, simply called listening point and orientation of the listener) and information about a playback environment, and mixes the sound sources. Specifically, the real-time playback signal generation unit 116 composites a plurality of acoustic signals corresponding to a plurality of areas based on the position and orientation of the virtual listening point to generate a playback acoustic signal corresponding to the listening point, that is, an acoustic signal for reproducing the sound that can be listened to at the listening point. The listening point may be specified by the user via an operation unit 996 in the audio signal processing apparatus 100 or may be automatically specified by the audio signal processing apparatus 100. The playback environment refers to an environment related to the configuration of a playback device on whether the playback apparatus to reproduce the signal generated by the real-time playback signal generation unit 116 is a speaker (stereo, surround, or multi-channel) or headphones. That is, in the mixing of the sound sources, the audio signals in the divided areas are composited and converted according to the environment such as the number of channels in the playback device.

In response to a replay request, the replay playback signal generation unit 117 acquires data as of the relevant time from the storage unit 115, performs the same process as that performed by the real-time playback signal generation unit 116, and outputs the data.

Figure 4:
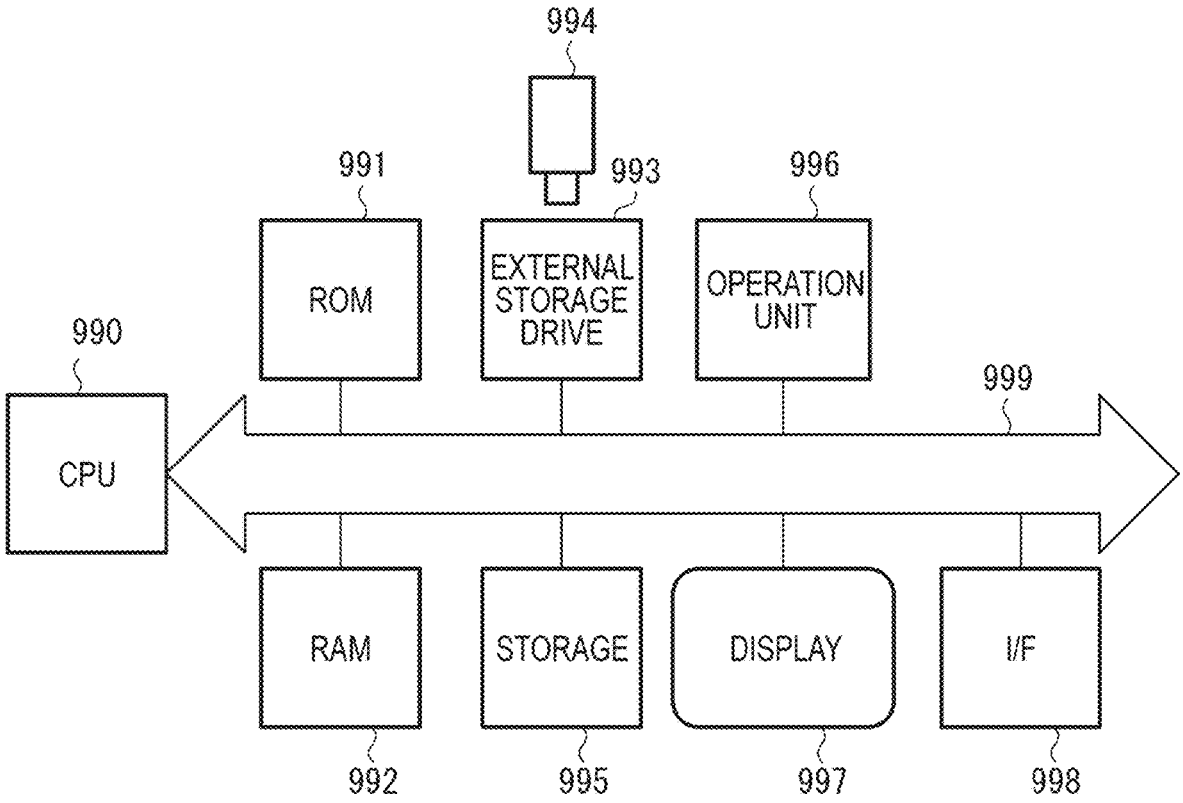
FIG. 4 is a block diagram of a hardware configuration of the audio signal processing apparatus.

FIG. 4 is a block diagram of a hardware configuration example of the audio signal processing apparatus 100. The audio signal processing apparatus 100 is implemented by a personal computer (PC), an installed system, a tablet terminal, a smartphone, or the like, for example.

Referring to FIG. 4, a CPU 990 is a central processing unit that controls the overall operation of the audio signal processing apparatus 100 in cooperation with other components based on computer programs. A ROM 991 is a read-only memory that stores basic programs and data for use in basic processes. A RAM 992 is a writable memory that serves as a work area for the CPU 990 and the like.

An external storage drive 993 enables access to a recording medium to load the computer programs and data from a medium (recording medium) 994 such as a USB memory into the system. A storage 995 is a device that serves as a large-capacity memory such as a solid-state drive (SSD). The storage 995 stores various computer programs and data.

An operation unit 996 is a device that accepts inputs of instructions and commands from the user, which corresponds to a keyboard, a pointing device, a touch panel, or the like. A display 997 is a display device that displays the commands input from the operation unit 996 and responses output from the audio signal processing apparatus 100 to the commands. An interface (I/F) 998 is a device that relays exchange of data with an external device. The microphone array 111 is connected to the audio signal processing apparatus 100 via the interface 998. A system bus 999 is a data bus that is responsible for the flow of data in the audio signal processing apparatus 100.

The functional elements illustrated in FIG. 1 are implemented by the CPU 990 controlling the entire apparatus based on the computer programs. Alternatively, the functional elements may be formed from software implementing the functions equivalent to those of the foregoing devices as substitute for the hardware devices.

(Processing Procedure)

Figure 5A:
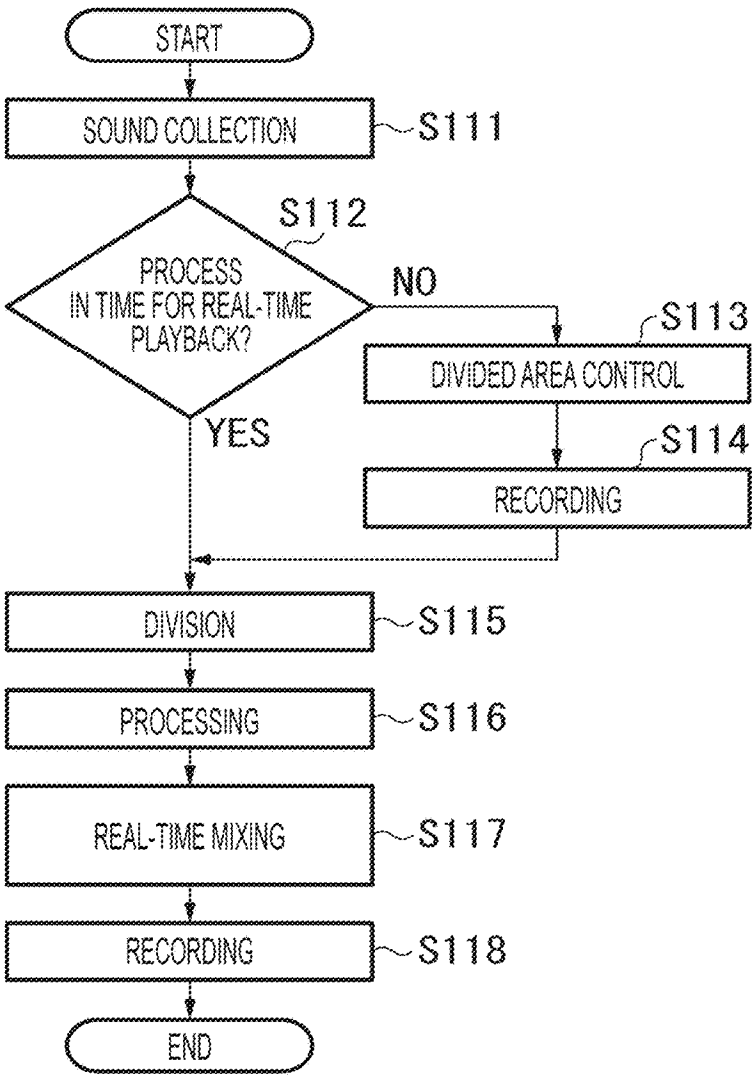
FIGS. 5A to 5C are flowcharts of audio signal processing.
Figure 5B:
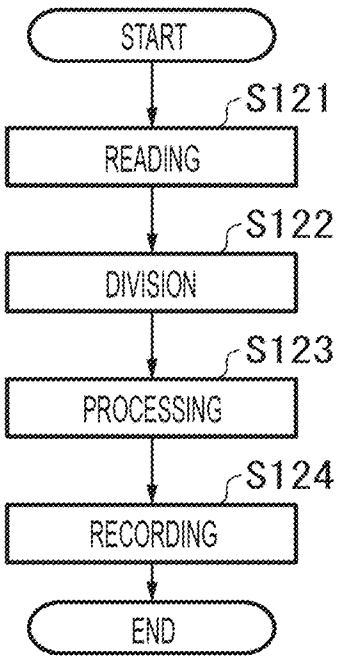
Figure 5C:
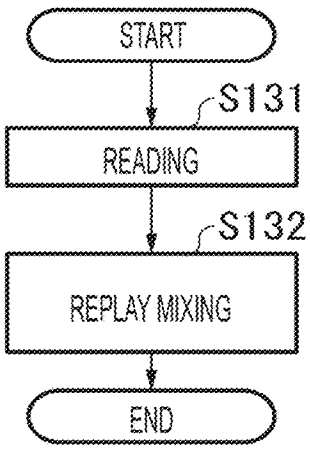

Subsequently, the procedure for a process executed by the audio signal processing apparatus 100 will be described with reference to FIGS. 5A to 5C. FIGS. 5A to 5C are flowcharts of the procedure for the process executed by the audio signal processing apparatus 100 of the embodiment.

FIG. 5A is a flowchart of sound collection to generation of a real-time playback signal. First, the microphone array 111 collects sounds in a space (S111). The microphone array 111 outputs the audio signals of the collected sounds in the individual channels to the sound source division unit 112.

Then, the divided area control unit 113 determines whether sound source division will be in time for real-time playback from the viewpoint of a processing load (S112). This process is performed based on the presence or absence of sounds at the predetermined level as described above with reference to FIG. 3.

When not determining that sound resource division will be in time for real-time playback (No at S112), the divided area control unit 113 controls the number of areas to decrease the sound source divided areas (S113). Specifically, for example, the divided area control unit 113 integrates the divided areas with low degrees of importance, such as areas in which no sounds at the specific level or higher are detected, to decrease the number of the divided areas. Then, the divided area control unit 113 outputs the information about which areas to be divided to the sound source division unit 112. Further, the divided area control unit 113 creates a divided area control list.

Then, the storage unit 115 records the audio signals of the frames having undergone the divided area control by the storage unit 115 (S114).

When the divided area control unit 113 determines that sound source division will be in time for real-time playback or after the recording at S114, the sound source division unit 112 performs the sound source division (S115). Specifically, the sound source division unit 112 composites the sounds in the divided areas based on the multi-channel signals collected at S111. As described above, the sounds in the divided areas can be reproduced by performing phase control on the audio signals collected by the microphones and adding a weight to the audio signals based on the relationship between the microphones constituting the microphone array 111 and the positions of the divided areas. The storage unit 115 outputs the audio signals in the divided areas to the audio signal processing unit 114.

Then, the audio signal processing unit 114 performs audio signal processing in each divided area (S116). The processing performed by the audio signal processing unit 114 includes, for example, a delay correction process for correcting the influence of the distance between the divided area and the sound collection apparatus, a gain correction process, noise processing by echo removal. The audio signal processing unit 114 outputs the processed audio signals to the real-time playback signal generation unit 116 and the storage unit 115.

Then, the real-time playback signal generation unit 116 mixes the sounds for real-time playback (S117). At the mixing, the signals are composited and converted so that the sounds can be played back according to the specifications of a playback device (for example, the number of channels and the like). The real-time playback signal generation unit 116 outputs the sounds mixed for real-time playback to an external playback device or outputs the same as broadcast signals.

Then, the storage unit 115 records the sounds in the individual areas (S118). The audio signals for replay playback are created using the sounds in the individual areas in the storage unit 115.

Next, descriptions will be given as to the operation in the case where the process cannot be in time for real-time playback at S112 described in FIG. 5A (No at S112) with reference to FIG. 5B.

When the load on the processing device is lower than a predetermined value, the divided area control unit 113 reads data from the storage unit 115 based on the divided area control list (S121).

Then, the divided area control unit 113 performs the sound source division process again in the areas before the integration where the sound source division was performed by integrating the areas in the divided area control list (S122). The divided area control unit 113 outputs the processed audio signals to the audio signal processing unit 114. The corresponding frame and areas are deleted from the divided area control list after the processing. S123 is identical to S116 and detailed description thereof will be omitted.

Then, the storage unit 115 overwrites and records the audio signals in the input areas (S124).

Next, a flow of the process in response to a replay request will be described with reference to FIG. 5C. With the replay request, the replay playback signal generation unit 117 reads the audio signals in the individual areas corresponding to the replay time from the storage unit 115 (S131).

Then, the replay playback signal generation unit 117 mixes the sounds for replay playback (S132). The replay playback signal generation unit 117 outputs the sounds mixed for replay playback to an external playback device or outputs the same as broadcast signals.

As described above, the divided areas are controlled according to the processing load. Specifically, an area in a specific space under a larger load of at least either the division of the sound sources or the generation of a playback signal is subdivided into finer divided areas. Accordingly, the degree of division is lowered in the areas with the sound levels lower than the predetermined value, whereas the process can be in time for the generation of a real-time playback signal with high resolution in the areas with the sound levels equal to or higher than the predetermined value. Further, dividing the area under divided area control with a light processing load makes it possible to obtain data with sufficient resolution at the time of a replay.

In the embodiment, the microphone array 111 is formed from microphones as an example. Alternatively, the microphone array 111 may be combined with a structure such as a reflector. In addition, the microphones in the microphone array 111 may be omnidirectional microphones, directional microphones, or a mixture of them.

In the embodiment, the sound source division unit 112 collects sounds in each area using beam forming as an example. Alternatively, the sound source division unit 112 may use another sound source division method. For example, the sound source division unit 112 may estimate power spectral density (PSD) in each area and perform sound source division by a wiener filter based on the estimated PSD.

In the embodiment, the divided area control unit 113 identifies the areas corresponding to objects in the sound collection target region using area sounds extracted from the sound collection signals collected by the microphone array 111, and divides the sound collection target region based on the identification results. Specifically, the divided area control unit 113 controls the divided areas depending on whether the sound levels in the areas are equal to or higher than the predetermined value. However, the divided area control unit 113 may have any other determination criterion. For example, even in the case of using the same sounds, the divided area control unit 113 may be configured to detect the characteristic amounts of sounds instead of the levels of sounds and determine the presence or absence of the characteristic amount. Specifically, when detecting sounds with predetermined characteristics such as sounds including screams, gunshots, ball-hitting sounds, or vehicle sounds by sound characteristic analysis, the divided area control unit 113 may reduce the divided areas to reproduce detailed sounds. In addition, for example, the space including at least part of the sound collection target region may be photographed so that the divided area control unit 113 can control the divided areas based on the photographed images. For example, the divided area control unit 113 may detect the position of a specific subject (object) such as a person, an animal, or a marker from a moving image and control the divided areas around the subject to be larger in size.

For live broadcasting on television or the like, there is generally known a system in which broadcasts are provided with a certain time lag of several seconds to several minutes behind actual shooting for the purpose of time adjustment or allowing for contingencies. In the case of using such a system, the divided area control unit 113 may control the division order according to the events included in video or audio for the delay time. For example, when there is a time lag of two minutes in a live broadcast of a sport, the divided area control unit 113 may set the divided areas for sound source division from the two-minute flow of the game. For example, when a player makes a shot on goal in a soccer game or the like, the divided area control unit 113 may detect the player and the movement of the ball from the two-minute video and set the divided areas around the path of the ball more finely. On the other hand, the divided area control unit 113 may set the divided areas without the player or the ball more roughly.

In the embodiment, the divided area control unit 113 decreases the number of areas as much as possible. Alternatively, the divided area control unit 113 may calculate the number of areas depending on the processing load and decrease the areas to the minimum necessary number.

In the embodiment, the divided area control unit 113 controls the divided areas using the sound level in the previous frame. Alternatively, the divided area control unit 113 may control the divided areas using information about the processed frame. Specifically, when the sound level in the divided area is equal to or higher than the predetermined value, the divided area control unit 113 instructs the sound source division unit 112 to perform sound source division in subdivided areas of that area. The divided area control unit 113 and the sound source division unit 112 repeatedly perform this process until the areas become small to a predetermined size. This prevents the delay of the divided area control for one frame. In this method, however, the processing amount increases with an increase in the number of sound sources. Accordingly, this method is used in the case where the number of sound sources is known to be small or the number of repetitions of the process is limited to an allowable range of processing load.

In the embodiment, the audio signal processing unit 114 performs the delay correction process, the gain correction process, and the echo removal. Alternatively, the audio signal processing unit 114 may perform other processes. For example, the audio signal processing unit 114 may perform a noise suppression process in each area.

In the embodiment, the replay playback signal generation unit 117 and the real-time playback signal generation unit 116 perform the same process. Alternatively, the replay playback signal generation unit 117 and the real-time playback signal generation unit 116 may perform mixing in different ways. For example, since sounds in roughly divided areas may be input into the real-time playback signal generation unit 116, the real-time playback signal generation unit 116 may lower the level of mixing in the large-sized areas depending on whether the process has been already performed.

Figure 6:
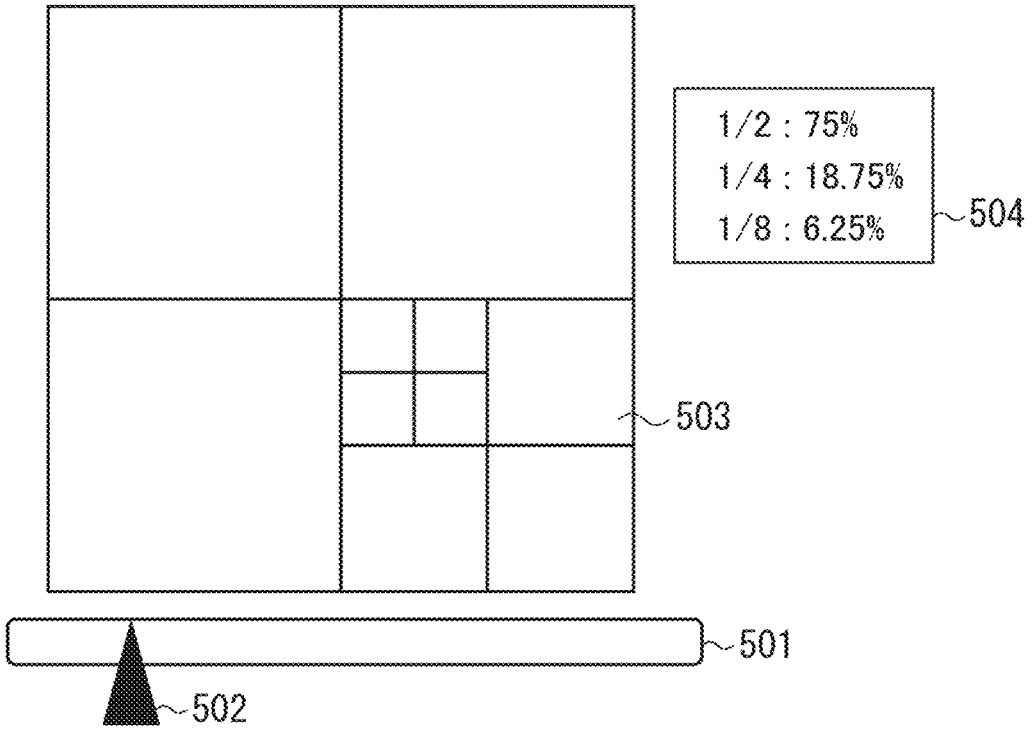
FIG. 6 is a diagram describing a display device for divided area control.

Although not described above in relation to the embodiment, display control may be performed to display the state of the area control on the display device as illustrated in FIG. 6. For example, a display screen displays a time bar 501, a time cursor 502, an area division indicator 503, an area division ratio indicator 504, and the like. The time bar 501 is a bar indicating the recording time up to the present time. The position of the time cursor 502 indicates the current time in the display window. The area division indicator 503 indicates the area division state as of the time indicated by the time cursor 502. The image of the division state may be superimposed on the image of the actual space or CGs reprinting the actual space. The area division ratio indicator 504 indicates the ratios of area division sizes. Alternatively, such a screen as illustrated in FIG. 3 may be displayed. This display allows the user to understand the area division state intuitively. The display device may further include an input device such as a touch panel. For example, the user may select the large-sized area by touching or the like so that the area can be subdivided on a priority basis.

Second Embodiment

A second embodiment relates to an acoustic system in which a plurality of users sets respective listening points and plays back the sounds according to the listening points by a playback apparatus. Differences from the first embodiment will be mainly described below.

(Acoustic System)

Figure 7:
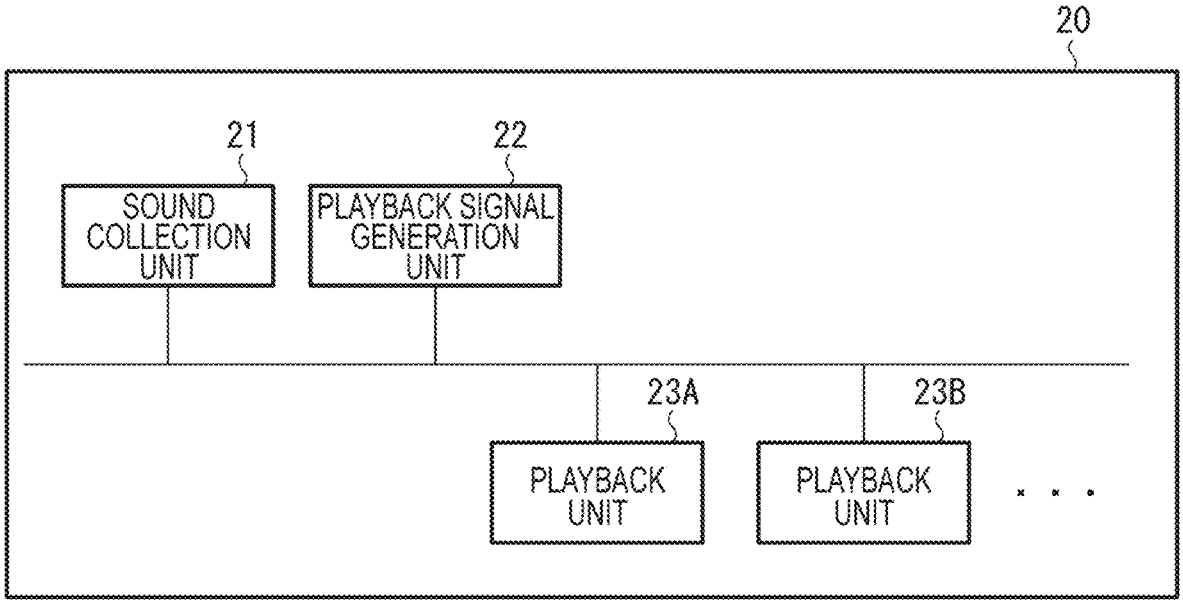
FIG. 7 is a diagram describing an acoustic system.

FIG. 7 is a block diagram of an acoustic system 20. The acoustic system 20 includes a sound collection unit 21, a playback signal generation unit 22, and a plurality of playback units 23. The sound collection unit 21, the playback signal generation unit 22, and the plurality of playback units 23 transmit and receive data to and from each other through wired or wireless transmission paths. The transmission paths between the sound collection unit 21, the playback signal generation unit 22, and the playback units 23 are implemented by dedicated communication paths such as a LAN but may be a public communication network such as the Internet.

Figure 8A:
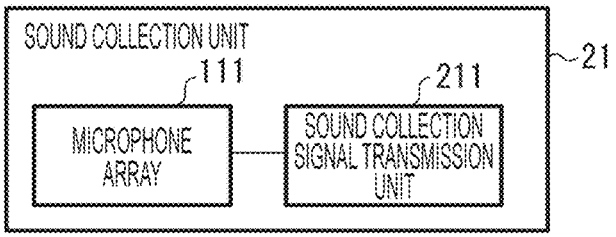
FIGS. 8A to 8C are block diagrams of a detailed configuration of the acoustic system.
Figure 8B:
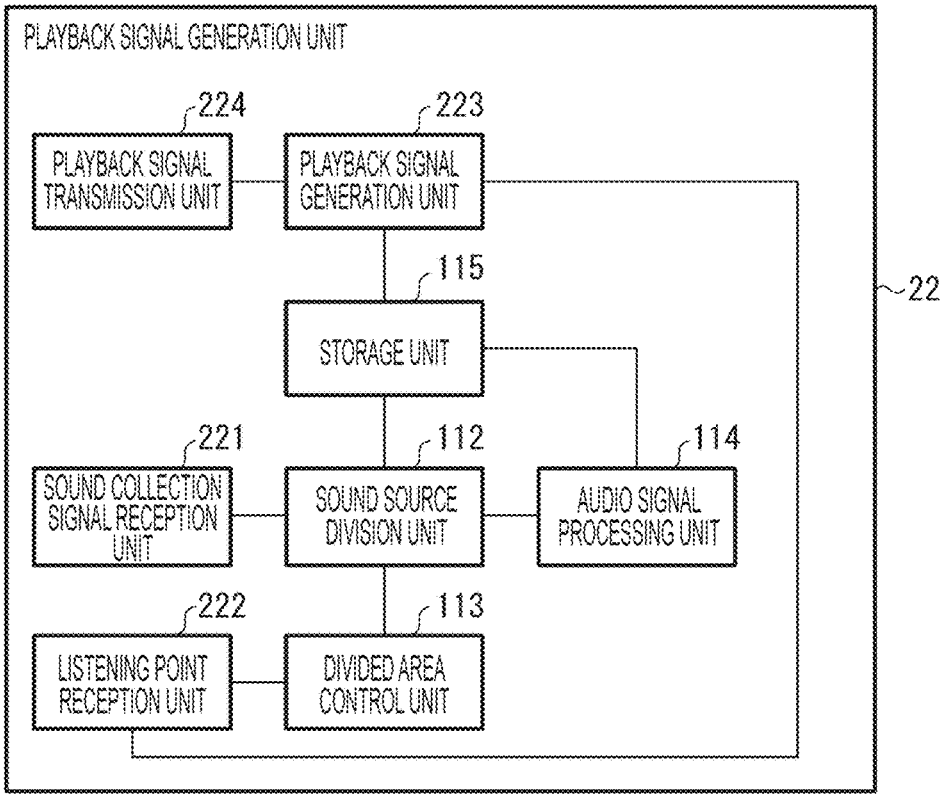
Figure 8C:
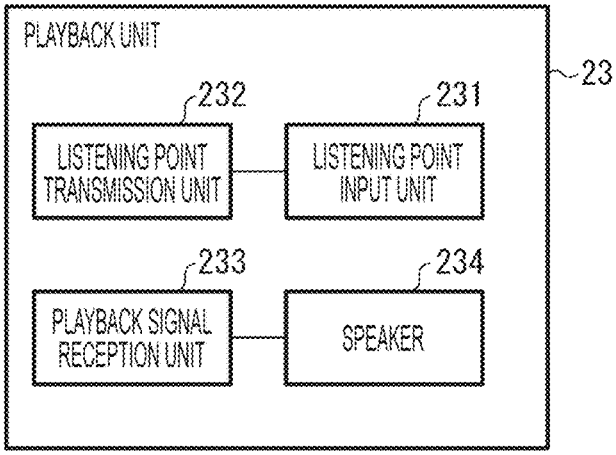

FIG. 8A is a block diagram of the sound collection unit 21, FIG. 8B is a block diagram of the playback signal generation unit 22, and FIG. 8C is a block diagram of the playback units 23. The sound collection unit 21 illustrated in FIG. 8A includes a microphone array 111 and a sound collection signal transmission unit 211. The microphone array 111 is the same as that in the first embodiment, and detailed descriptions thereof will be omitted. The sound collection signal transmission unit 211 transmits a microphone signal input from the microphone array 111.

The playback signal generation unit 22 illustrated in FIG. 8B includes a sound source division unit 112, a divided area control unit 113, an audio signal processing unit 114, a storage unit 115, a sound collection signal reception unit 221, a listening point reception unit 222, a playback signal generation unit 223, and a playback signal transmission unit 224. The sound source division unit 112, the audio signal processing unit 114, and the storage unit 115 are almost the same as those in the first embodiment and detailed descriptions thereof will be omitted.

Figure 9A:
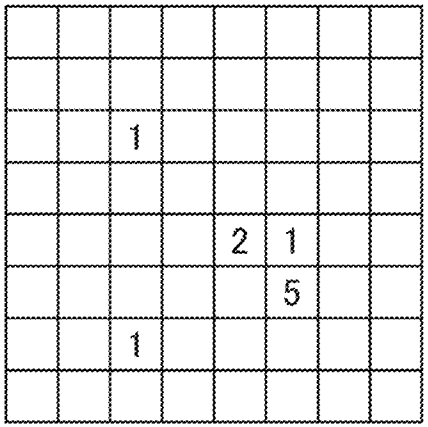
FIGS. 9A to 9C are illustrative diagrams of divided area control.
Figure 9B:
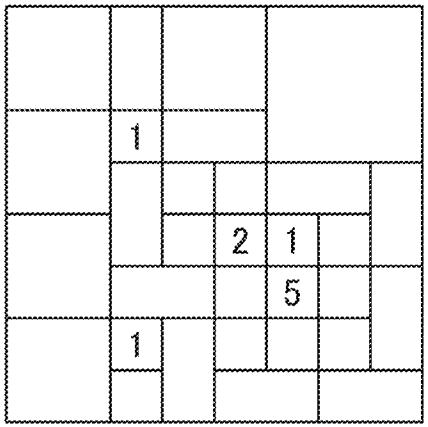

The divided area control unit 113 controls the areas in which the sound source division unit 112 performs sound source division based on a plurality of listening points input from the listening point reception unit 222 described later. The listening point refers to information including the position and orientation of a virtual listener in a space set by the user, and time. For example, the divided area control unit 113 monitors the processing load on the playback signal generation unit 22, and controls the areas in such a manner as to decrease the number of the divided areas with an increase in the load based on the distribution of the listening points. For example, it is assumed that the positions of the listeners set by the users listening in real time are distributed as illustrated in FIG. 9A. In that case, as illustrated in FIG. 9B, area control is performed such that the areas with a larger number of listening points and its surrounding areas are divided finely and the areas with a small number of listening points are roughly divided. Alternatively, the sizes of the divided areas may be simply determined such that the sizes of the divided areas with listening points are smaller than the sizes of the divided areas without listening points.

When the user specifies a listening point as of a time in the past, that is, when the user requests a replay, the divided area control unit 113 determines whether the sound source division process is necessary based on the state of the divided areas as of that time and the specified viewpoint, and performs sound source division if necessary depending on the processing load. For example, when no area control was performed at the specified time or when area control was performed at the specified time but sound source division is performed in sufficiently fine areas at and around the currently specified listening point, there is no need to divide the areas again. Meanwhile, when area control was performed at the specified time and the areas at and around the currently specified listening point are roughly divided, the divided area control unit 113 outputs a control signal to the sound source division unit 112 to subdivide the areas at and around the listening point.

The sound collection signal reception unit 221 receives the sound collection signal from the sound collection unit 21. The listening point reception unit 222 receives the listening points from the plurality of playback units 23. The listening point reception unit 222 outputs the received listening points to the divided area control unit 113 and the playback signal generation unit 223. The playback signal generation unit 223 has the combined functions of the real-time playback signal generation unit 116 and the replay playback signal generation unit 117 in the first embodiment. The playback signal generation unit 223 generates a playback signal according to the positions and orientations of the listeners and the time input from the listening point reception unit 222. The playback signal generation unit 223 operates as the real-time playback signal generation unit 116 does when the input time is real time, and operates as the replay playback signal generation unit 117 does when the input time is a time in the past. The playback signal generation unit 223 outputs the audio signals generated at the listening points to the playback signal transmission unit 224. The playback signal transmission unit 224 outputs the received audio signals at the listening points to the playback units 23.

Each of the playback units 23 illustrated in FIG. 8C includes a listening point input unit 231, a listening point transmission unit 232, a playback signal reception unit 233, and a speaker 234. The listening point input unit 231 is an input device by which the user can set time and the position and orientation of a virtual listener in a space where sounds are collected. The listening point input unit 231 is implemented by a keyboard, a pointing device, or a touch panel. The listening point input unit 231 outputs the set listening point to the listening point transmission unit 232.

The listening point transmission unit 232 outputs the listening point set by the user to the listening point reception unit 222. The playback signal reception unit 233 receives the audio signal corresponding to the listening point set by the listening point input unit 231, and outputs the same to the speaker 234. The speaker 234 subjects the input audio signal to D/A conversion and emits the sound.

(Processing Procedure)

Figure 10A:
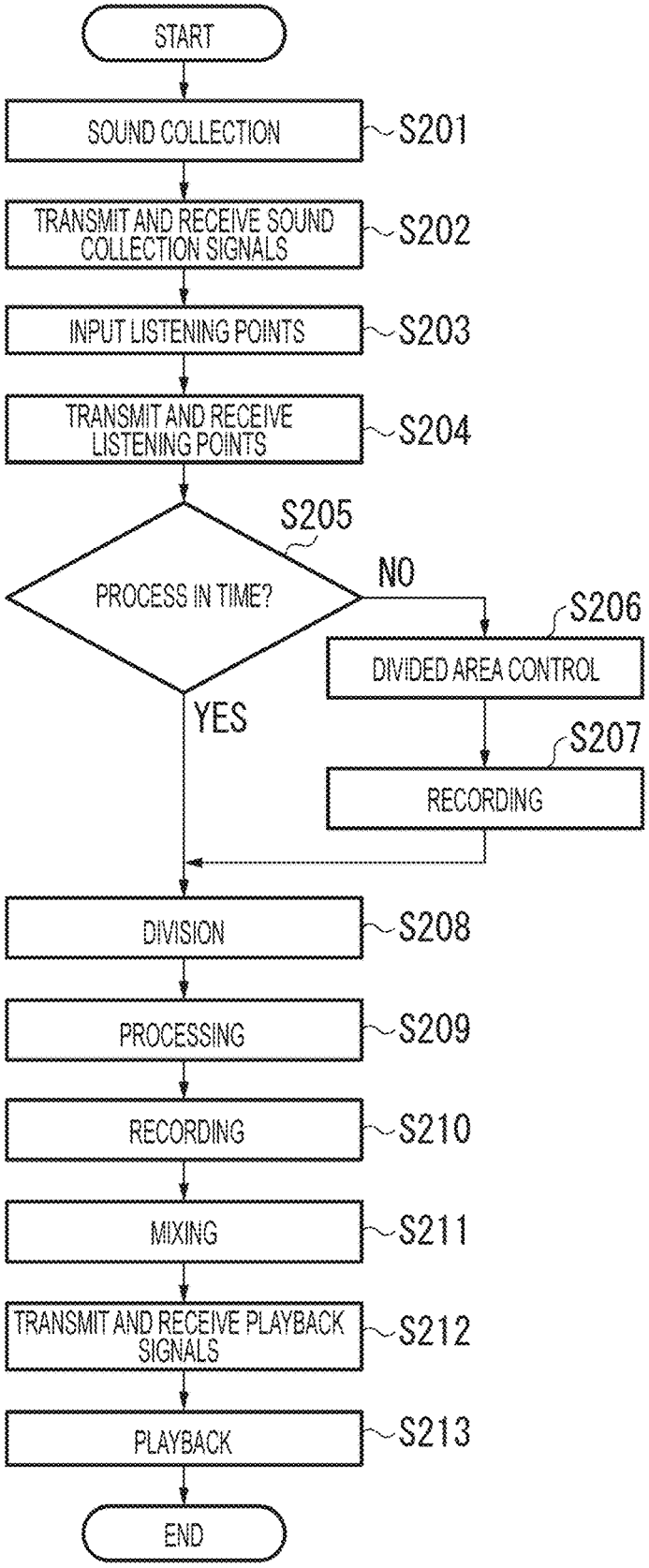
FIGS. 10A and 10B are flowcharts of audio signal processing.
Figure 10B:
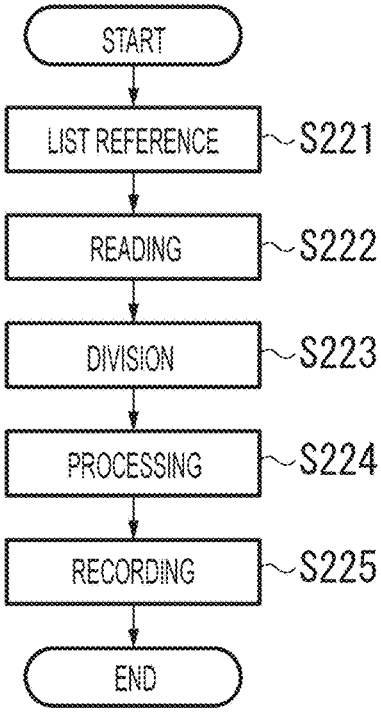

Subsequently, a procedure for a process executed by the acoustic system 20 will be described with reference to FIGS. 10A and 10B. FIGS. 10A and 10B are flowcharts of the procedure for the process executed by the acoustic system 20 of the embodiment.

As illustrated in FIG. 10A, first, the microphone array 111 collects sounds in a space (S201). The microphone array 111 outputs the collected sounds to the sound collection signal transmission unit 211. The sound collection signal transmission unit 211 of the sound collection unit 21 transmits the sound collection signal, and the sound collection signal reception unit 221 of the playback signal generation unit 22 receives the sound collection signal (S202). The sound collection signal reception unit 221 outputs the received sound collection signal to the sound source division unit 112. The listening point input units 231 in the plurality of playback units 23 input listening points (S203). The listening point input unit 231 outputs the input listening points to the listening point transmission unit 232.

The listening point transmission unit 232 transmits the listening points, and the listening point reception unit 222 of the playback signal generation unit receives the listening points (S204). The listening point reception unit 222 outputs the received plurality of listening points to the divided area control unit 113 and the playback signal generation unit 223.

The divided area control unit 113 determines whether the process will be in time for real-time playback (S205). When the divided area control unit 113 determines that the process will be in time for real-time playback (YES at S205), the process moves to S208. When the divided area control unit 113 does not determine that the process will be in time for real-time playback (NO at S205), the process moves to S206.

At S206, the divided area control unit 113 performs divided area control. Specifically, at S206, the divided area control unit 113 controls the sound source division unit 112 to integrate a plurality of areas to decrease the number of areas. Further, the divided area control unit 113 generates a divided area control list to manage control information about the divided areas. When the areas are controlled, the sound source division unit 112 outputs the sound collection signal in that frame to the storage unit 115, and the storage unit 115 records the input sound collection signal (S207). Then, the process moves to S208.

At S208, the sound source division unit 112 performs sound source division in each area. The sound source division unit 112 outputs an audio signal in each divided area to the audio signal processing unit 114.

The audio signal processing unit 114 processes the audio signal (S209). The audio signal processing unit 114 outputs the processed audio signal to the storage unit 115.

The storage unit 115 records the processed audio signal in each area (S210). The playback signal generation unit 223 acquires from the storage unit 115 the sounds in each area according to the times at the plurality of listening points input from the listening point reception unit 222, and mixes the playback sounds at each of the listening points (S211). The playback signal generation unit 223 outputs the plurality of mixed playback signals to the playback signal transmission unit 224.

The playback signal transmission unit 224 transmits the plurality of playback signals generated at each of the listening points, and the playback signal reception units 233 of the playback units 23 receive the playback signals corresponding to the input listening points (S212). Finally, the playback signals received by the playback signal reception units 233 are played back from the speaker (S213).

Next, referring to FIG. 10B, descriptions will be given as to the process in the case where it is not determined at S205 described in FIG. 10A that the process will be in time and the number of the areas is decreased.

When the processing load falls below a predetermined value, the divided area control unit 113 refers to the divided area control list to determine the division time (frame) and the areas to be divided (S221). The divided area control unit 113 outputs the information about the areas to be divided and the time to the sound source division unit 112.

Then, the sound source division unit 112 reads the sound collection signal based on the time information input from the storage unit 115 (S222). S223 to S225 are identical to S208 to S210, and descriptions thereof will be omitted.

As described above, the divided areas are combined based on the processing load and the distribution of the plurality of listening points to decrease the number of areas. This makes it possible to reproduce the important audio signals faithfully and perform the real-time process with enhanced efficiency. Further, at the time of a replay, the playback signal can be generated using divided sounds even in the areas where the transmission was not in time for the real-time playback.

In the embodiment, the playback units 23 are all configured in the same manner. However, the playback units 23 may be configured differently. Although not described herein, the playback units 23 may be used in combination with a free-viewpoint video generation system that generates free-viewpoint video. For example, a plurality of imaging apparatuses captures images of a space almost the same as the space where sounds are collected in all directions to generate a free-viewpoint video from the captured images. In that case, the listening points may be calculated from the viewpoints, or the free-viewpoint video may be generated in conjunction with the listening points.

Figure 9C:
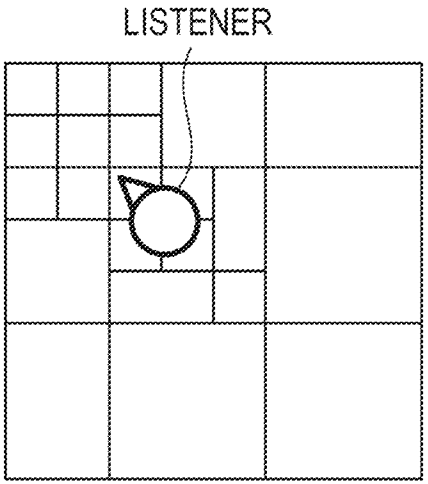

In the embodiment, the playback signal generation unit 223 is formed in the playback signal generation unit 22. Alternatively, the playback signal generation unit 223 may be formed in the playback units 23. In the embodiment, the divided area control unit 113 determines the divided areas using only the positions of the plurality of listeners. Alternatively, as illustrated in FIG. 9C, the divided area control unit 113 may divide finely the area existing on the front side of the front side in the listening direction with respect to the orientation of the listener and divide roughly the area existing on the back side with respect to the orientation of the listeners.

In the embodiment, when area control is performed, the listening positions capable of being input from the listening point input unit 231 may be limited. In the embodiment, the playback units 23 handle uniformly the listening points. Alternatively, the playback units 23 may have weights different among the listening points for control of the divided areas. In addition, as in the first embodiment, the system may include a display device for displaying the state of area control and an input device for providing an instruction for divided area control.

In the embodiments, the number of the areas where sound source division is to be performed is controlled also in the case of a real-time playback with a limited time before starting of a playback to collect sounds in the entire space and play back the sounds with resolutions maintained in the important areas.

Third Embodiment

In the first and second embodiments described above, the space as a sound collection target is mainly divided into rectangular divided areas. Meanwhile, in a third embodiment, area division is performed by a method different from the foregoing division method. In a signal processing system according to the third embodiment, the positions of a plurality of objects possibly as sound sources in the sound collection target area are detected, and the sound collection target area is divided into a plurality of divided areas where sounds are collected according to the detected positions of the objects. In addition, in the signal processing system, the directivity of a sound collection unit is formed in each of the divided areas and the sounds of the objects included in the divided areas are acquired.

(Configuration of the Signal Processing System)

Figure 11:
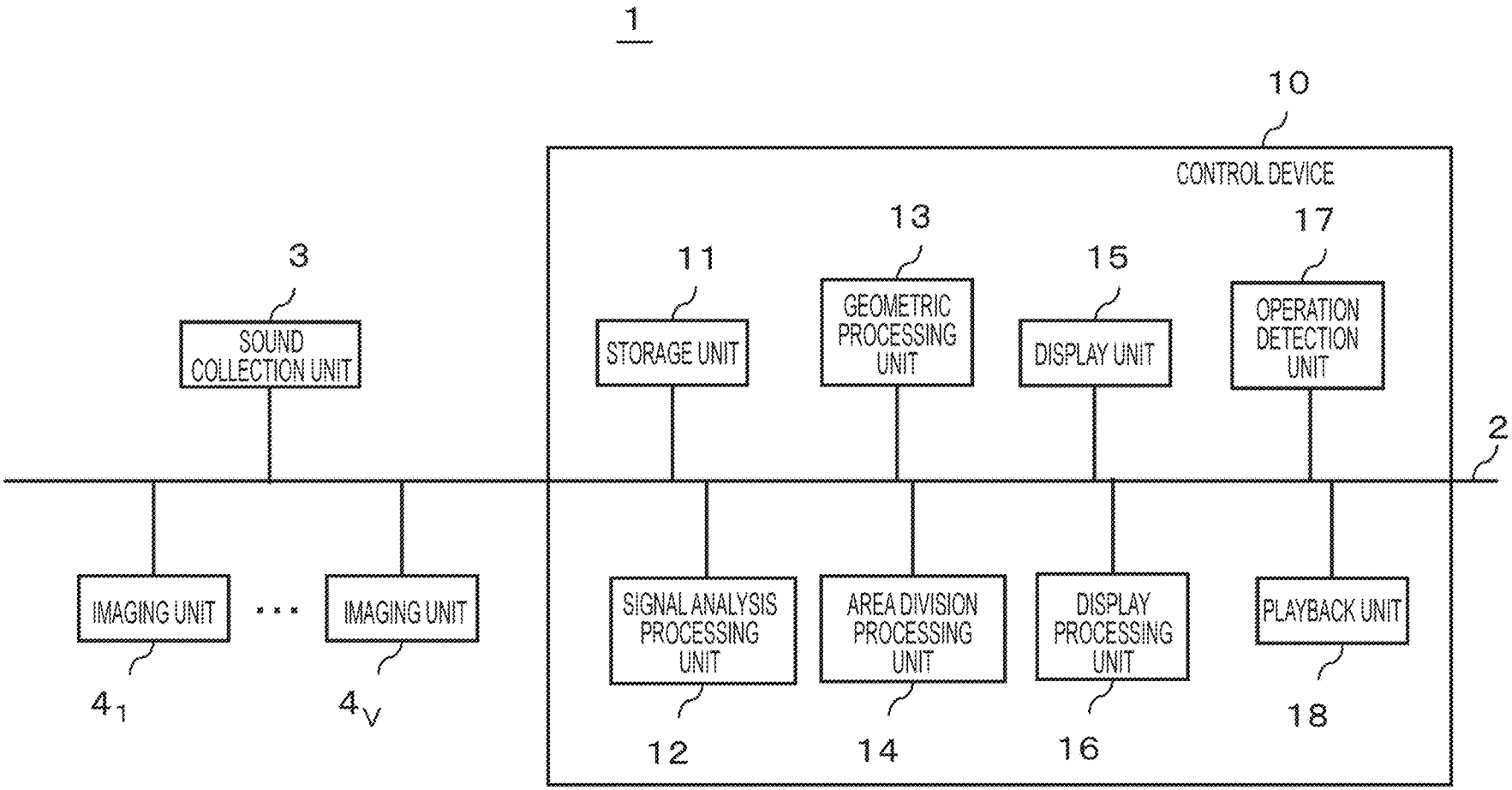
FIG. 11 is a block diagram of a signal processing system.

FIG. 11 is a block diagram of a signal processing system 1 according to the third embodiment. The signal processing system 1 includes a control device 10 that controls the entire system, a sound collection unit 3 and V imaging units $\mathbf{4}_1$ to $\mathbf{4}_V$ that are disposed in a sound collection target area. The control device 10, the sound collection unit 3, and the imaging units $\mathbf{4}_1$ to $\mathbf{4}_V$ are connected via a network 2. The sound collection unit 3 is formed from M-channel microphone array including M microphone elements, for example, and includes an interface (I/F) for amplification and AD conversion related to sound collection, and supplies collected acoustic signals to the control device 10 via the network 2. The number of the sound collection units 3 is not limited to one but a plurality of sound collection units 3 may be provided.

The imaging units $\mathbf{4}_1$ to $\mathbf{4}_V$ are formed from cameras, include imaging-related I/Fs, and supply video signals obtained by imaging to the control device 10 via the network 2. The sound collection unit 3 is disposed in a clear positional and orientational relationship with at least one of the imaging units $\mathbf{4}_1$ to $\mathbf{4}_V$.

Figure 12:
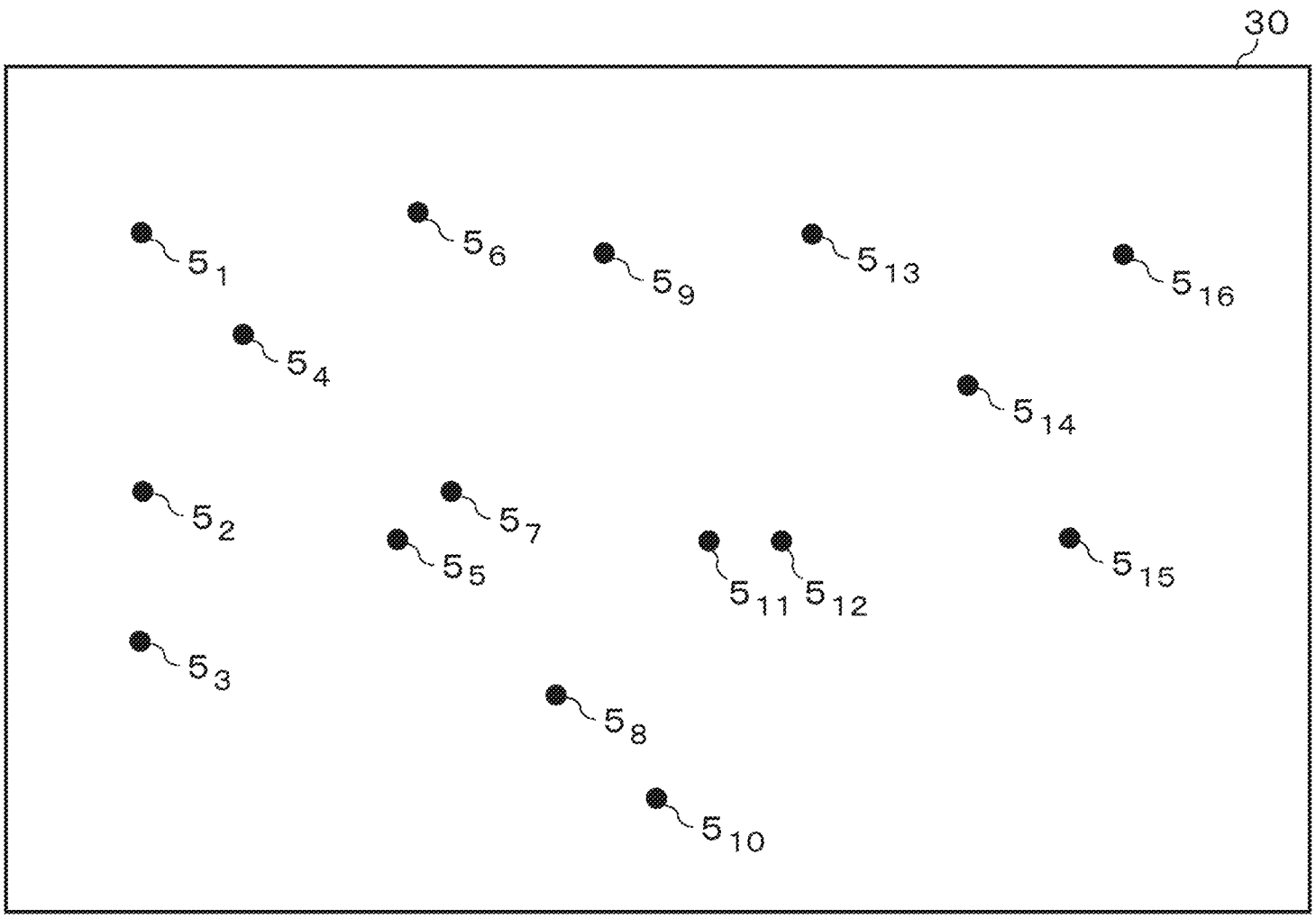
FIG. 12 is a diagram of a sound collection target region.

The sound collection unit 3 collects sounds in the sound collection target area. The sound collection target area is a target region where the sound collection unit 3 collects sounds. In the embodiment, a ground area in a stadium is set as a sound collection target area 30, for example, as illustrated in FIG. 12. FIG. 12 is a two-dimensional top view of the ground area as the sound collection target area 30. Reference signs $\mathbf{5}_1$ to $\mathbf{5}_{16}$ in FIG. 12 represent the positions of objects possibly as sound sources in the sound collection target area 30, for example, the positions of a ball, players, referees, and the like in a soccer game.

The control device 10 includes a storage unit 11 that stores various data, a signal analysis processing unit 12, a geometric processing unit 13, an area division processing unit 14, a display unit 15, a display processing unit 16, an operation detection unit 17, and a playback unit 18.

The control device 10 records sequentially the acoustic signals supplied from the sound collection unit 3 and the video signals supplied from the imaging units $\mathbf{4}_1$ to $\mathbf{4}_V$ in the storage unit 11.

The storage unit 11 also stores data on filter coefficients for formation of directivity, transfer functions between the sound sources and the microphone elements in the microphone array in individual directions, sound collection ranges with various specifications of oriented directions and sharpness of directivity, head-related transfer functions, and others.

The signal analysis processing unit 12 analyzes the acoustic signals and the video signals. For example, the signal analysis processing unit 12 multiplies the acoustic signals collected by the sound collection unit (microphone array) 3 by a selected filter coefficient for formation of directivity to form the directivity of the sound collection unit 3.

The geometric processing unit 13 performs processing related to the position, orientation, and shape of directivity of the sound collection unit 3. The area division processing unit 14 performs processing related to division of the sound collection target area. The display unit 15 is typically a display that is formed from a touch panel, for example, in the embodiment. The display processing unit 16 generates indications related to the division of the sound collection target area and displays the indications on the display unit 15. The operation detection unit 17 detects a user operation input into the display unit 15 formed from a touch panel. The playback unit 18 is formed from headphones, includes I/F for DA conversion and amplification related to playback, and reproduces the generated playback signals from the headphones.

(Hardware Configuration)

The functional blocks of the control device 10 illustrated in FIG. 11 are stored as programs in a storage unit such as a ROM 92 described later and executed by a CPU 91. At least some of the functional blocks illustrated in FIG. 11 may be implemented by hardware. To implement the functional blocks by hardware, for example, a predetermined compiler is used to generate automatically a dedicated circuit on an FPGA from a program for executing the steps. The FPGA is an abbreviation for field programmable gate array. As in the case with the FPGA, a gate array circuit may be formed to implement the functional blocks as hardware. Alternatively, the functional blocks may be implemented as hardware by an application specific integrated circuit (ASIC).

Figure 13:
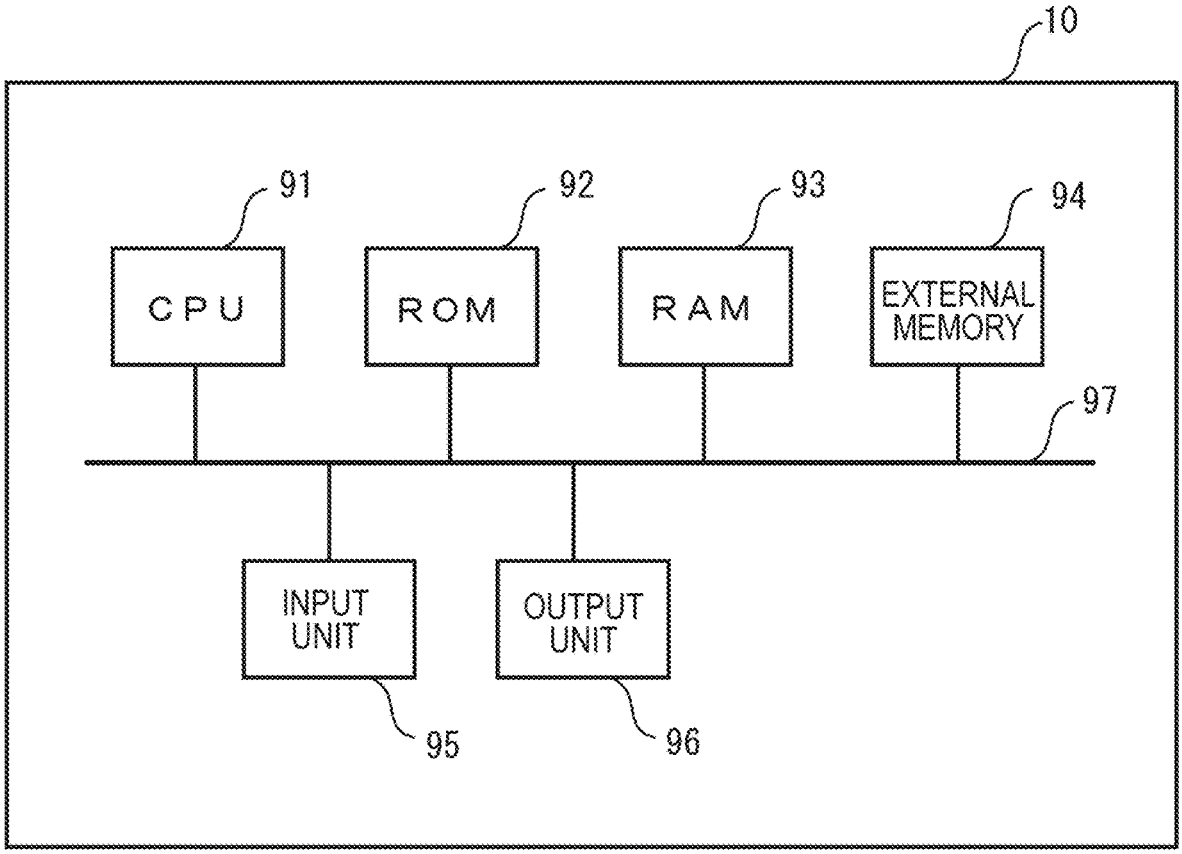
FIG. 13 is a diagram of a hardware configuration example.

FIG. 13 illustrates an example of a hardware configuration of the control device 10. The control device 10 has the CPU 91, the ROM 92, a RAM 93, an external memory 94, an input unit 95, and an output unit 96. The CPU 91 performs various arithmetic operations and controls the components of the control device 10 according to input signals or programs. Specifically, the CPU 91 controls the directivity of the sound collection unit that collects sounds in a sound collection target area, generates a display image to be displayed on the display unit 15, and others. The functional blocks illustrated in FIG. 11 indicate functions to be performed by the CPU 91.

The RAM 93 stores temporary data and is used for working of the CPU 91. The ROM 92 stores the programs for executing the functional blocks illustrated in FIG. 11 and various kinds of setting information. The external memory is a detachable memory card, for example, and can be attached to a personal computer (PC) or the like to read data therefrom.

A predetermined area of the RAM 93 or the external memory 94 is used as the storage unit 11. The input unit 95 stores the acoustic signals supplied from the sound collection unit 3 in the area of the RAM 93 or the external memory 94 used as the storage unit 11. The input unit 95 stores the video signals supplied from the imaging units $\mathbf{4}_1$ to $\mathbf{4}_V$ in the area of the RAM 93 or the external memory 94 used as the storage unit 11. The output unit 96 displays the display image generated by the CPU 91 on the display unit 15.

(Details of the Signal Processing)

The signal processing in the embodiment will be described with reference to the flowchart described in FIG. 14.

At S1, the geometric processing unit 13 and the signal analysis processing unit 12 cooperate to calculate the positions and orientations of the imaging units $\mathbf{4}_1$ to $\mathbf{4}_V$. Further, the geometric processing unit 13 and the signal analysis processing unit 12 cooperate to calculate the position and orientation of the sound collection unit 3 in a clear positional and orientational relationship with any of the imaging units $\mathbf{4}_1$ to $\mathbf{4}_V$. In this case, the position and orientation are described in a global coordinate system. For example, the point of origin in the global coordinate system is set in the center of the sound collection target area 30, an x axis and a y axis are set in parallel to the sides of the sound collection target area 30, and a z axis is set upward in a vertical direction perpendicular to the two axes. Accordingly, the sound collection target area 30 is described as a sound collection target area plane in which the ranges of the x coordinate and the y coordinate are limited when z=0.

The positions and orientations of the imaging units $\mathbf{4}_1$ to $\mathbf{4}_V$ can be calculated by a publicly known method called camera calibration using a plurality of video signals obtained by imaging calibration markers disposed widely in the sound collection target area by the plurality of imaging units $\mathbf{4}_1$ to $\mathbf{4}_V$, for example. When the positions and orientations of the imaging units $\mathbf{4}_1$ to $\mathbf{4}_V$ are known, the position and orientation of the sound collection unit 3 in a clear positional and orientational relationship with at least any one of the imaging units can be calculated.

The method for calculating the position and orientation of the sound collection unit 3 is not limited to the calculation from video signals. The sound collection unit 3 may include a global positioning system (GPS) receiver or an orientation sensor to acquire the position and orientation of the sound collection unit. Alternatively, as disclosed in Japanese Patent Laid-Open No. 2014-175996, for example, calibration sound sources may be disposed in the sound collection target area 30 so that the positions and orientations of A sound collection units $\mathbf{3}_1$ to $\mathbf{3}_A$ may be calculated from the acoustic signals collected by the sound collection units $\mathbf{3}_1$ to $\mathbf{3}_A$. In addition, calibration markers, sound sources, GPSs, or the like may be disposed at the four corners of the sound collection target area so that the positions of the four corners of the sound collection target area 30 in the global coordinate system can be acquired at S1. Accordingly, the sound collection target area 30 is described as a sound collection target area plane in which the ranges of the x coordinate and the y coordinate are limited when z=0.

Next, at S2, the operation detection unit 17 detects a user operation input to acquire a virtual listening position and orientation (direction) in the current time block (having a predetermined time length) necessary for a playback of the sounds in the divided areas at a later step.

Figure 15:
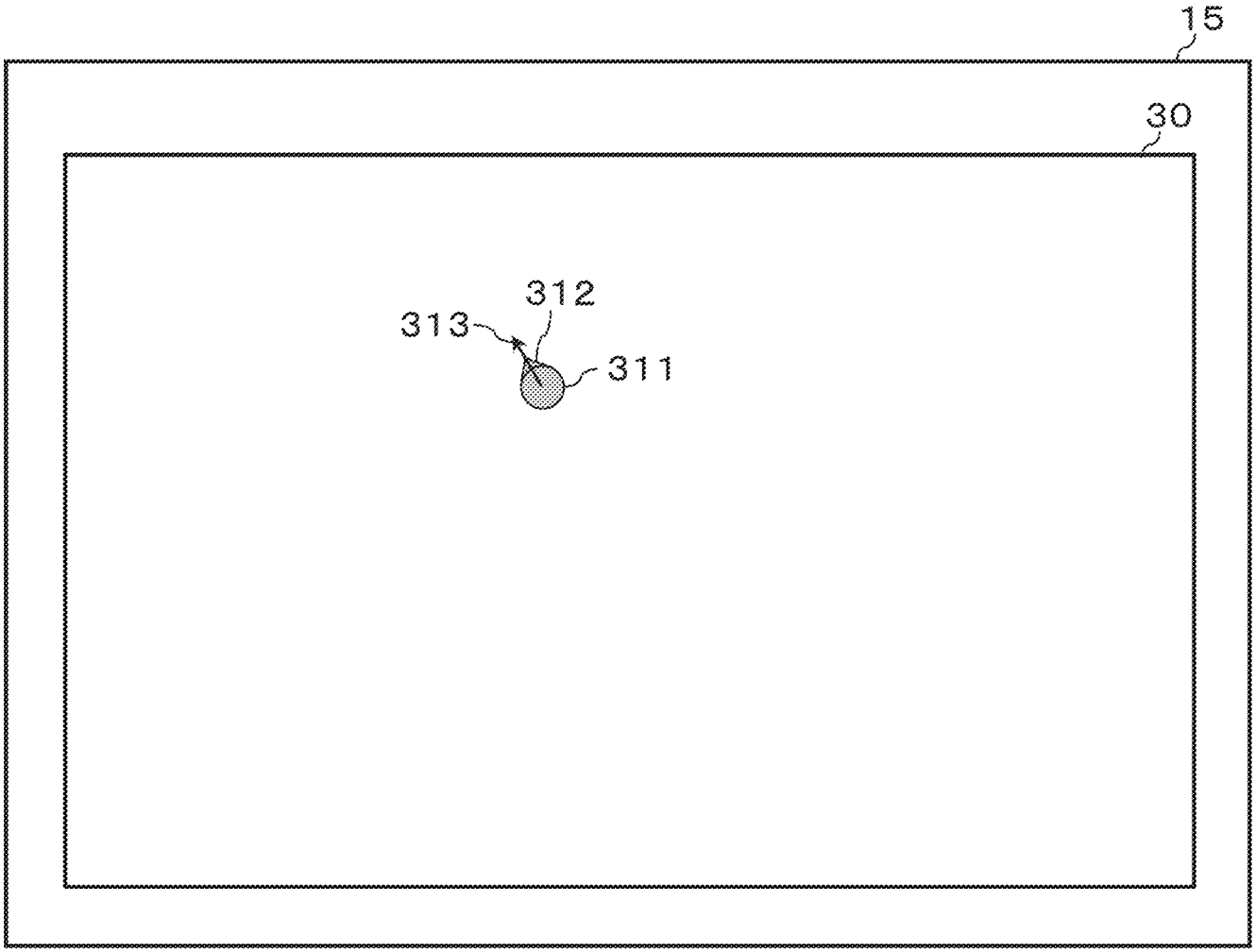
FIG. 15 is a diagram of an input window for a virtual listening position.

Specifically, as illustrated in FIG. 15, the display processing unit 16 displays on the display screen of the display unit 15 an image of the sound collection target area 30 and an image of a virtual listening position 311. In FIG. 15, the center of a circle 311 schematically representing a head denotes the virtual listening position, and the vertex of an isosceles triangle 312 schematically representing a nose denotes the virtual listening direction. In this case, an arrow 313 is added for ease of comprehension. The start point of the arrow corresponds to the virtual listening position, and the direction of the arrow corresponds to the virtual listening direction.

When detecting a user operation input such as moving the circle 311 by dragging or rotating the isosceles triangle 312 by dragging, the operation detection unit 17 inputs the virtual listening position and orientation in the current time block according to the operation input. The display processing unit 16 creates the image as illustrated in FIG. 15 and displays the same on the display unit 15 according to the virtual listening position and orientation input by the operation detection unit 17.

At S3, the signal analysis processing unit 12 acquires the video signals in the current time block captured by the imaging units $\mathbf{4}_1$ to $\mathbf{4}_V$, and uses video recognition to detect objects possibly as sound sources. For example, the signal analysis processing unit 12 may use a publicly known mechanical learning or human detection technique to detect objects that can emit sounds such as the players or the ball.

Then, the geometric processing unit 13 calculates the positions of the detected objects. The calculated positions of the objects are representative positions of the objects (for example, the centers of object detection frames). For example, based on the assumption that the z coordinate in the ground area plane as the sound collection target area 30 is equal to 0, the representative positions of the objects may be associated with the positions (x, y) in the sound collection target area in the global coordinate system.

The method for acquiring the positions of the objects in the global coordinate system is not limited to the acquisition from video signals. For example, GPSs may be attached to the players and the ball to acquire the positions of the objects in the global coordinate system.

From the foregoing, as illustrated in FIG. 12, for example, the positions of objects $\mathbf{5}_1$ to $\mathbf{5}_{16}$ are calculated.

Figure 16:
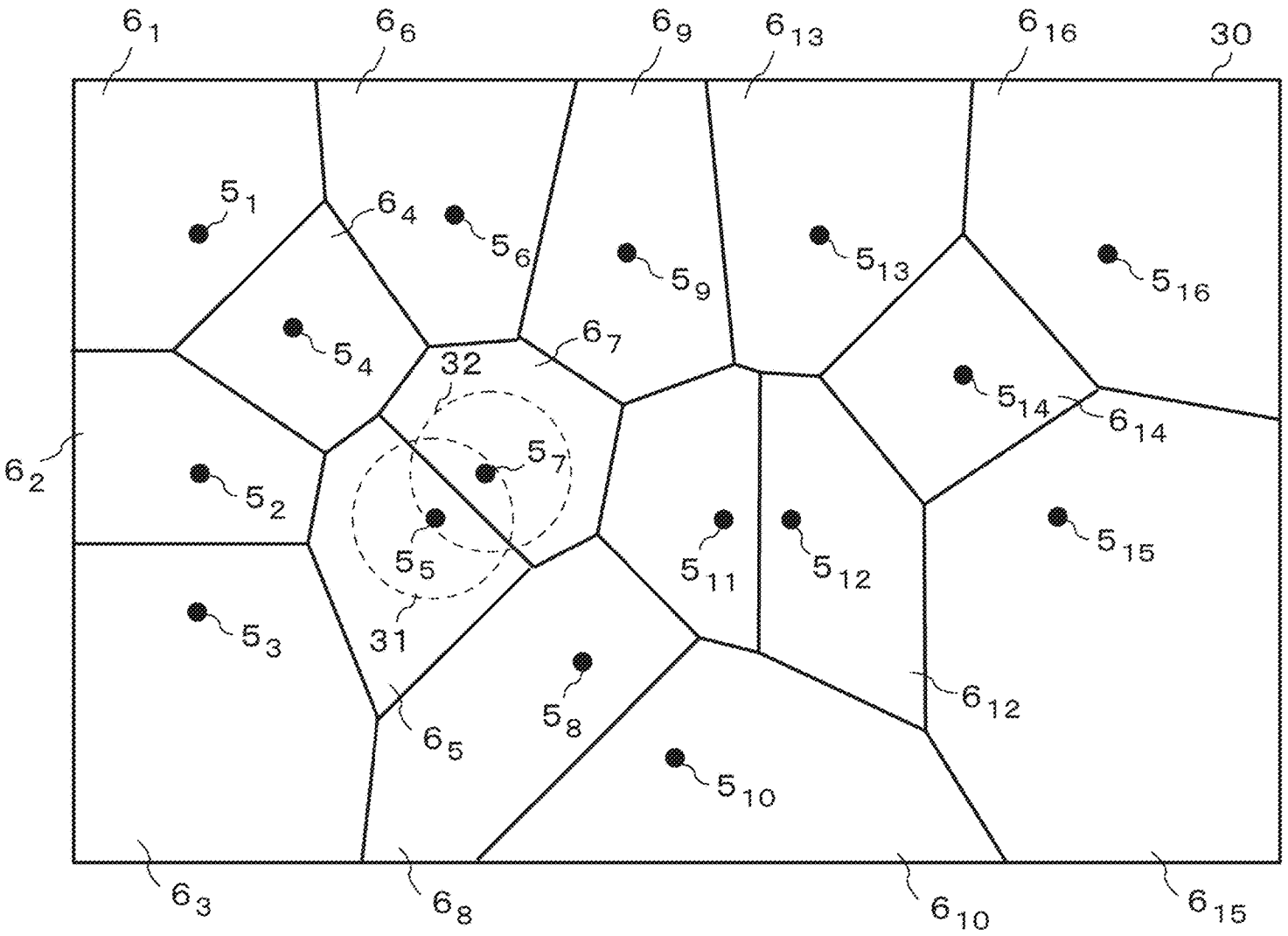
FIG. 16 is an illustrative diagram of area division.

At S4, the area division processing unit 14 performs Voronoi tessellation of the sound collection target area with the positions of the objects in the sound collection target area calculated at S3 as generating points. Accordingly, as illustrated in FIG. 16, for example, the sound collection target area 30 is divided into a plurality of divided areas (Voronoi areas) partitioned by Voronoi boundaries. In FIG. 16, black circles represent the positions of the objects (generating points of Voronoi tessellation), and one object is included in each of the divided areas. Performing process at S3 and S4 in each time block (or repeatedly performing process at S3 to S10 in each time block) makes it possible to collect sounds in dynamically divided areas of the sound collection target area 30 according to the movements of the objects.

At S5, the signal analysis processing unit 12 acquires the acoustic signals (sound collection signals) in M channels in the current time block in which the sound collection unit (M-channel microphone array) 3 collects sounds, and subjects the acoustic signals to Fourier conversion in each channel to obtain z(f) as frequency area data (Fourier coefficient). In this case, f represents a frequency index, and z(f) represents a vector having M elements.

S6 to S8 are repeatedly performed for each frequency in a frequency loop. Further, S6 to S8 are repeatedly executed for each of the divided area (Voronoi areas) determined at S4 in a divided area loop.

At S6, the signal analysis processing unit 12 acquires a directional filter coefficient $w_d(f)$ for acquiring appropriately the sounds in the divided areas targeted in the current divided area loop. In this case, d (=1 to D) represents an index for divided area and D represents the total number of the divided areas. The filter coefficient $w_d(f)$ for formation of directivity are held in advance in the storage unit 11. The filter coefficient (vector) is frequency area data (Fourier coefficient) which is formed from M elements.

In the embodiment, acquiring appropriately the sounds in the divided areas means that the sound collection ranges in the sound collection target area 30 according to the directivity are adapted to the divided areas and the sounds of the objects included in the divided areas are appropriately acquired. That is, a plurality of acoustic signals corresponding to a plurality of sound collection ranges is acquired as a plurality of acoustic signals corresponding to a plurality of divided areas.

(Calculation of the Sound Collection Range)

First, the calculation of the sound collection range according to the directivity will be described. Specifically, the signal analysis processing unit 12 calculates a directional beam pattern and calculates the sound collection range according to the beam pattern.

More specifically, first, the signal analysis processing unit 12 multiplies the filter coefficient for formation of directivity by an array manifold vector as a transfer function between the sound source in each direction and each microphone element in the microphone array held in the storage unit 11 to calculate a directional beam pattern. In this case, a curve formed in a direction in which the amount of attenuation from the oriented direction of the beam pattern meets a predetermined value (for example, 3 dB) will be discussed. This curve will be called directional curve. The sounds in the directional curve are acquired, and the sounds outside the directional curve are suppressed. That is, the acoustic signals corresponding to the sound collection range become the acoustic signals in which the sounds outside the sound collection range are suppressed as compared to the sounds in the sound collection range.

The directional curve is rotated and translated using the posture and position of the sound collection unit 3 calculated at S1 to obtain the directional curve in the global coordinate system. Accordingly, for the directional curve expressed in the global coordinate system, the cross section of the sound collection target area plane described at S1 is calculated and set as sound collection range, and the sounds in the sound collection range are acquired and the sounds outside the sound collection range are suppressed. In addition, the area of the sound collection range is calculated at the same time. When the sound collection unit 3 collects the sounds in the sound collection target area from above and the oriented direction of the directivity has an evaluation angle with respect to the sound collection target area, for example, a sound collection range 31 corresponding to the object $\mathbf{5}_5$ illustrated in FIG. 16 is formed. The process for determining the cross section of a solid figure as described above can be performed by using a technique such as a publicly known 3 dimension computer-aided design (3D CAD).

Further, the geometric processing unit 13 and the signal analysis processing unit 12 cooperate to adapt the sound collection ranges in the sound collection target area to the divided areas and determine directivity such that the sounds of the objects included in the divided areas can be acquired appropriately.

If directivity of arbitrary sharpness is used with the directions of the objects (generating points) as oriented directions without allowing for division of the sound collection target area at S4, there occurs overlapping between a plurality of sound collection ranges such as sound collection ranges 31 and 32 illustrated in FIG. 16. In this case, one sound collection range may include a plurality of objects, and in that case, the sounds of the objects cannot be separately acquired. That is, for example, it is not possible to acquire separately the voices of individual players or play back the same as separate sound sources.

Accordingly, in the embodiment, the sound collection ranges in the sound collection target area can be adapted to the divided areas by methods described below in sequence.

According to a first method, the directivity is determined such that the area of the sound collection range is larger than a predetermined value under the conditions that the sound collection range includes an object (generating point) in the target divided area and the outer edge of the sound collection range does not cross the boundary between the divided areas (Voronoi boundary) but is inscribed in the divided area. In this case, a plurality of sound collection ranges is set corresponding to a plurality of objects, and the sound collection ranges are included in different ones of the plurality of divided areas.

Figure 17:
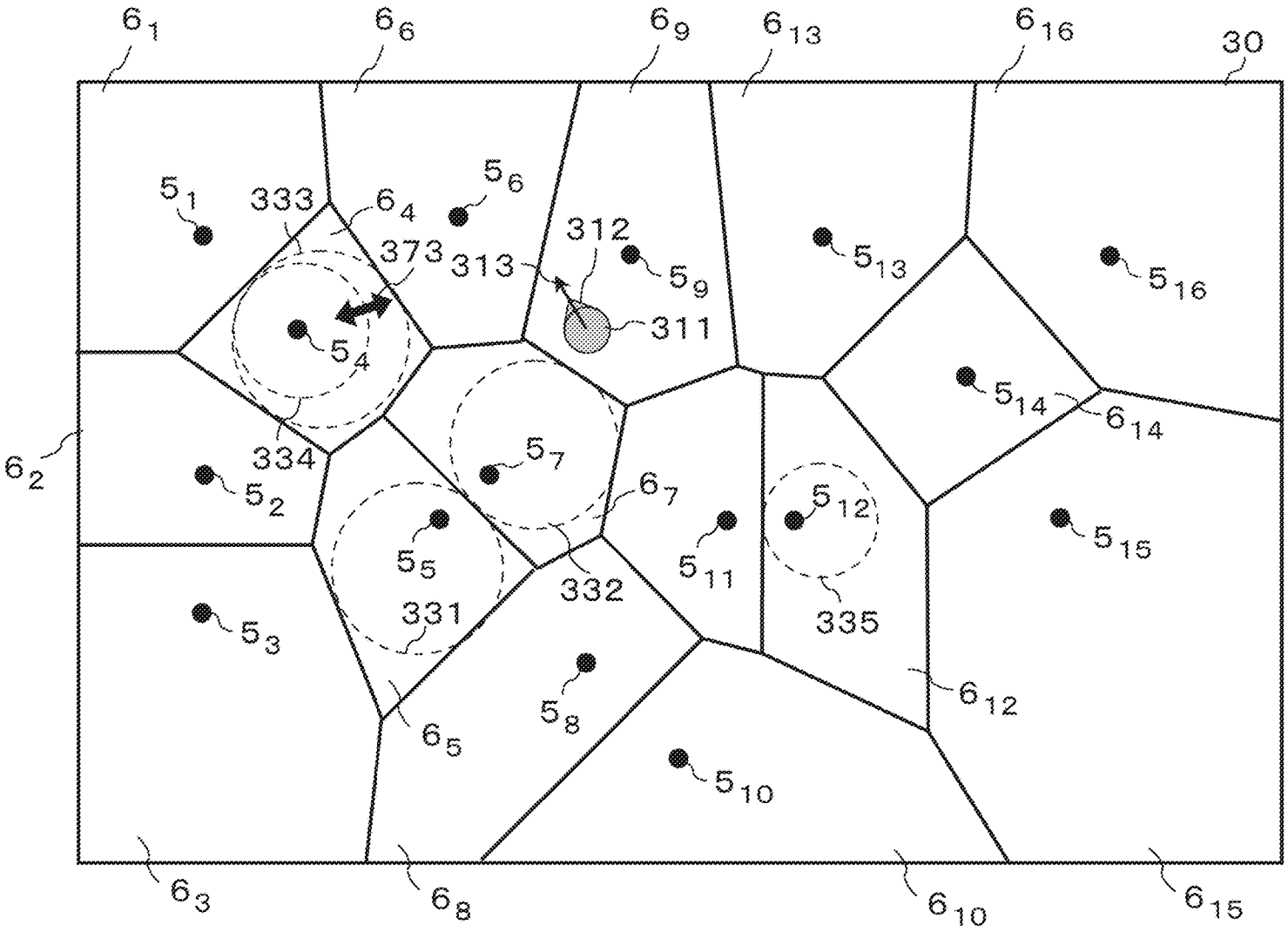
FIG. 17 is an illustrative diagram of sound collection ranges.

Reference signs 331 and 332 in FIG. 17 represent examples of sound collection ranges according to the directivity determined by the first method. Controlling the directivity such that the sound collection ranges fall within the respective divided area makes it possible to acquire the sounds of the objects separately without overlapping between the plurality of sound collection ranges. The areas of the sound collection ranges are made larger than a predetermined value, in other words, the directivity is made loose as much as possible because loose directivity generally allows a shorter filter length for formation of directivity, whereby the reduction in the amount of processing for formation of directivity can be expected.

There is a limit in sharpening the directivity, that is, narrowing the sound collection range, but loosening the directivity, that is, widening the sound collection range is generally possible. According to the first method, the oriented direction of directivity diverges somewhat from the directions of the objects, but the objects are included in the sound collection ranges and the sounds of the objects can be acquired.

The directivity according to the first method can be determined by assigning the oriented directions to the target divided areas and verifying the sound collection range in succession while gradually loosening the sharpness of the directivity from the sharpest directivity, for example.

In general, the filter coefficient for formation of directivity is associated with oriented direction ($\theta$, $\varphi$) in spherical coordinate representation (radius r, azimuth angle $\theta$, elevation angle $\varphi$) in a microphone array coordinate system of the sound collection unit 3. Accordingly, as a pre-process, the geometric processing unit 13 uses the position and orientation of the sound collection unit 3 calculated at S1 to convert the oriented position (intersection point of the oriented direction and the sound collection target area plane) described in the global coordinate system into the microphone array coordinate system. The geometric processing unit 13 further converts the coordinate-converted oriented position from orthogonal coordinate representation (x, y, z) to spherical coordinate representation (r, θ, φ).

The sound collection ranges with various specifications of oriented direction and sharpness of directivity may be calculated and held in advance in the storage unit 11.

When the sound collection range cannot be inscribed in the divided area, the oriented direction and sharpness of directivity may be controlled such that the area of the sound collection range protruding from the divided area becomes smaller than a predetermined value.

According to a second method, the directivity is determined such that the area of the sound collection range becomes larger than a predetermined value under the conditions that the oriented direction is fixed to the direction of the object (generating point) and the sound collection range does not cross over the boundary between the divided areas but is inscribed in the divided area.

In FIG. 17, reference sign 333 represents an example of a sound collection range according to the directivity determined by the first method, and reference sign 334 represents an example of a sound collection range determined according to the directivity determined by the second method. According to the second method, the direction of the object is set as oriented direction, and the object can be captured by a main lobe of directivity. In addition, since the area of the sound collection range is made larger than the predetermined value with the oriented direction fixed, the reduction in the amount of processing for formation of directivity can be expected although not so much as in the first method.

According to the second method, the directivity can be determined by verifying the sound collection range in succession while gradually loosening the sharpness of the directivity from the sharpest directivity, for example, with the oriented direction fixed to the direction of the object.

According to the third method, the sharpness of the directivity is predetermined (arbitrary) (for example, the directivity may be sharpest). In addition, the directivity is determined such that, when the sound collection range does not fall within a single divided area, the oriented direction is corrected from the direction of the object so that the sound collection range does not cross over the boundary between the divided areas but is inscribed in the divided area. That is, the sound collection range is set not centered on the position of the object. The directivity may be determined such that the amount of correction of the oriented direction becomes minimum. Reference sign 335 in FIG. 17 represents an example of a sound collection range according to the directivity determined by the third method.

According to the third method, the directivity can be determined by verifying the sound collection range in succession while moving gradually the oriented direction from the direction of the object (generating point) (in the direction in which the area of the sound collection range protruding from the divided area becomes smaller) with the sharpness of the directivity fixed.

In all the foregoing method examples (the first to third methods), the sound collection range is inscribed in the divided area and is adapted to the divided area. That is, in the foregoing examples, the directivity of the sound collection unit is controlled such that the sound collection range is at least partially inscribed in the divided area.

The signal analysis processing unit 12 acquires from the storage unit 11 the filter coefficient $w_d(f)$ for formation of directivity determined by the methods as described above.

At S7, the signal analysis processing unit 12 applies the filter coefficient $w_d(f)$ for formation of directivity acquired at S6 to the Fourier coefficient z(f) of the M-channel acoustic signal in the current time block acquired at S5. Accordingly, the signal analysis processing unit 12 generates a divided area sound $Y_d(f)$ corresponding to the current divided area loop as shown in Equation (1) where $Y_d(f)$ represents frequency area data (Fourier coefficient). Each divided area sound includes the sound of the corresponding object (object sound).

[Math. 1]

$$Y_d(f)=w_d^H(f)z(f) \tag{1}$$

The geometric processing unit 13 may calculate a distance $S_d$ between the object and the sound collection unit 3 and the signal analysis processing unit 12 may multiply $Y_d(f)$ by $S_d$ to compensate for distance attenuations of sounds different from object to object. The signal analysis processing unit 12 may multiply $Y_d(f)$ by a phase component according to a distance difference between a reference distance (for example, the maximum value of $S_d$ [d=1 to D]) and $S_d$ to absorb distance delay differences between the sounds of the objects.

Figure 18:
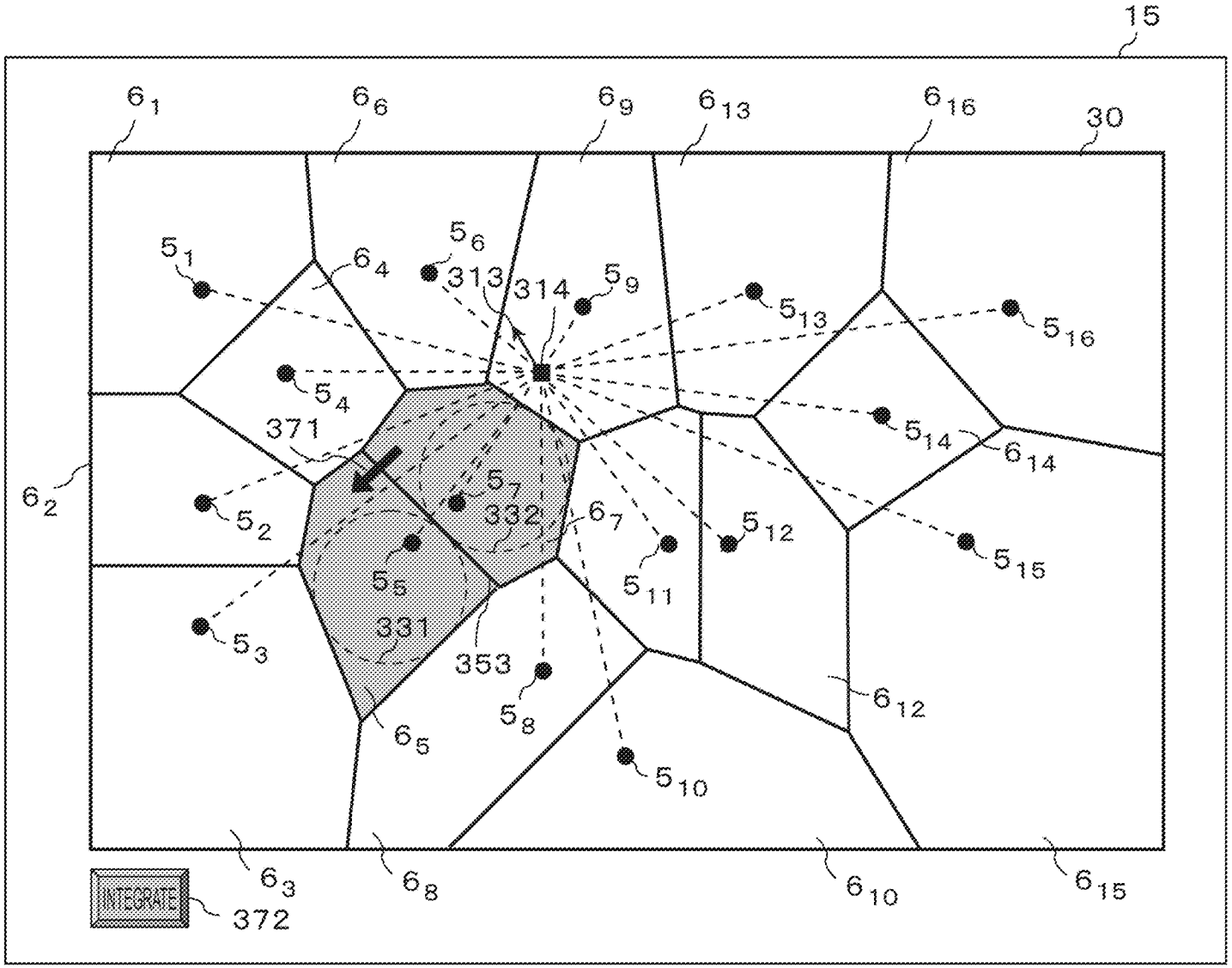
FIG. 18 is a schematic view of area division.

At S8, the geometric processing unit converts the position of the object (generating point) described in the global coordinate system to a head-related coordinate system prescribed by the virtual listening position and orientation acquired at S2, and further converts orthogonal coordinate representation to spherical coordinate representation. This is because a head-related transfer function (HRTF) used at this step is generally associated with the orientation in spherical coordinate representation in the head-related coordinate system. In FIG. 18, a black square 314 represents a virtual listening position as a simple indication, and a line linking the virtual listening position and each object corresponds to the direction of the object in the head-related coordinate system.

The signal analysis processing unit 12 further applies an HRTF of right and left ears [$H_L$ (f, $\theta_d$, $\varphi_d$), $H_R$ (f, $\theta_d$, $\varphi_d$)] corresponding to the direction of the object ($\theta_d$, $\varphi_d$) to the Fourier coefficient $Y_d(f)$ of the divided area sounds acquired at S7. The signal analysis processing unit 12 then adds the Fourier coefficient with the application of the HRTF to right and left headphone playback signals $X_L(f)$ and $X_R(f)$ as shown in Equation (2). In this case, $X_L(f)$ and $X_R(f)$ are frequency area data (Fourier coefficients). The HRTF to be used can be acquired from the storage unit 11.

[Math. 2]

$$\begin{cases} X_L(f) \leftarrow X_L(f) + H_L(f, \theta_d, \varphi_d)Y_d(f) \\ X_R(f) \leftarrow X_R(f) + H_R(f, \theta_d, \varphi_d)Y_d(f) \end{cases} \tag{2}$$

The geometric processing unit 13 may calculate a distance $T_d$ between the object and the virtual listening position and the signal analysis processing unit 12 may divide $Y_d(f)$ by $T_d$ to express the distance attenuation in each divided area sound (object sound) with respect to the virtual listening position. In addition, the signal analysis processing unit 12 may multiply $Y_d(f)$ by a phase component corresponding to $T_d$ to express the distance delay difference of each divided area sound (object sound) with reference to the virtual listening position. That is, at least one of the level and delay of the acoustic signal in each divided area is corrected according to the distance between the object corresponding to each divided area and the virtual listening position.

Performing this step in the divided area loop produces the effect of disposing successively virtual speakers for playing back the divided area sounds (object sounds) around the user, thereby reproducing a sound field as if the user exists in the sound collection target region.

At S9, the signal analysis processing unit 12 subjects the Fourier coefficients $X_L(f)$ and $X_R(f)$ of the headphone playback signals generated at S8 to inverse Fourier conversion to acquire headphone playback signals $x_L(t)$ and $x_R(t)$ of the current time block as a time waveform. The signal analysis processing unit 12 multiplies the headphone playback signals by a window function, for example, overlap-adds the same to the headphone playback signals down to the previous time block, and records successively the obtained headphone playback signals in the storage unit 11.

The foregoing steps are repeated to generate a sound image of the acoustic signal in each of the divided areas.

At S10, the playback unit 18 performs DA conversion and amplification on the headphone playback signals $x_L(t)$ and $x_R(t)$ acquired at S9 and reproduces the same from the headphones.

As described above, according to the embodiment, the sound collection target area is divided into divided areas according to the positions of the objects, the directivity of the sound collection unit is formed in each of the divided areas, and the sound of the object included in each of the divided areas is acquired. Accordingly, it is possible to acquire the sounds of the plurality of objects appropriately regardless of the positions of the objects.

Process at S1 may be performed in advance and the processing results may be held in the storage unit 11. In the embodiment, the various data held in the storage unit 11 may be externally input via a data input/output unit not illustrated.

Modification Example 1

Figure 14:
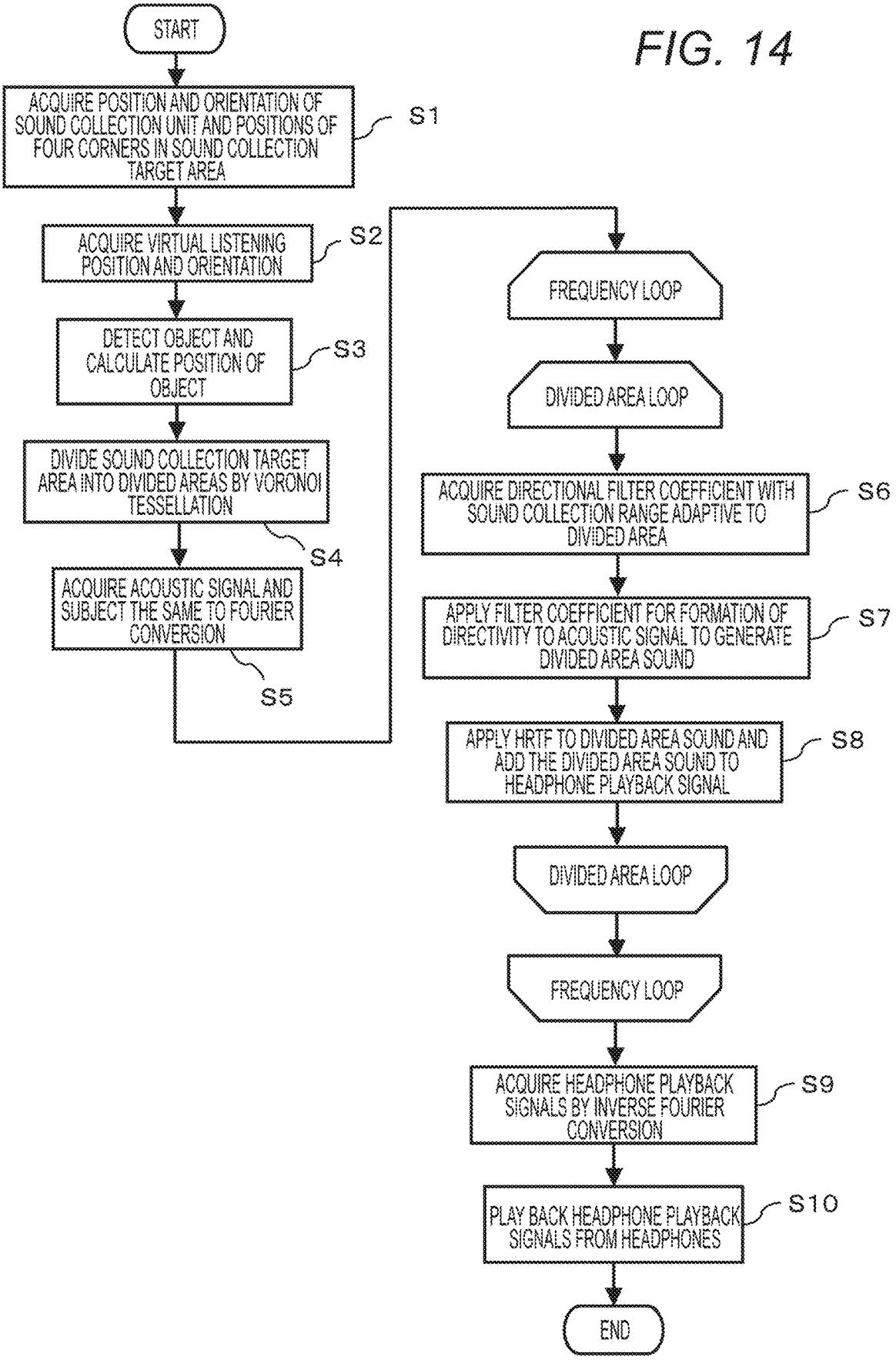
FIG. 14 is a flowchart of detailed signal processing.

In the third embodiment described above, the sounds of the objects detected at S3 described in FIG. 14 are acquired separately. However, when the directions of the plurality of objects (the objects $\mathbf{5}_5$ and $\mathbf{5}_7$ in the example of FIG. 18) seen from the virtual listening position 314 (head-related coordinate system) are in proximity with each other as illustrated in FIG. 18, the HRTFs almost equal in direction are applied to these object sounds at S8. In this case, it is less significant to acquire separately the sounds of the plurality of objects. Therefore, the sounds of the objects may be collectively acquired in each directivity (sound collection range).

Figure 19:
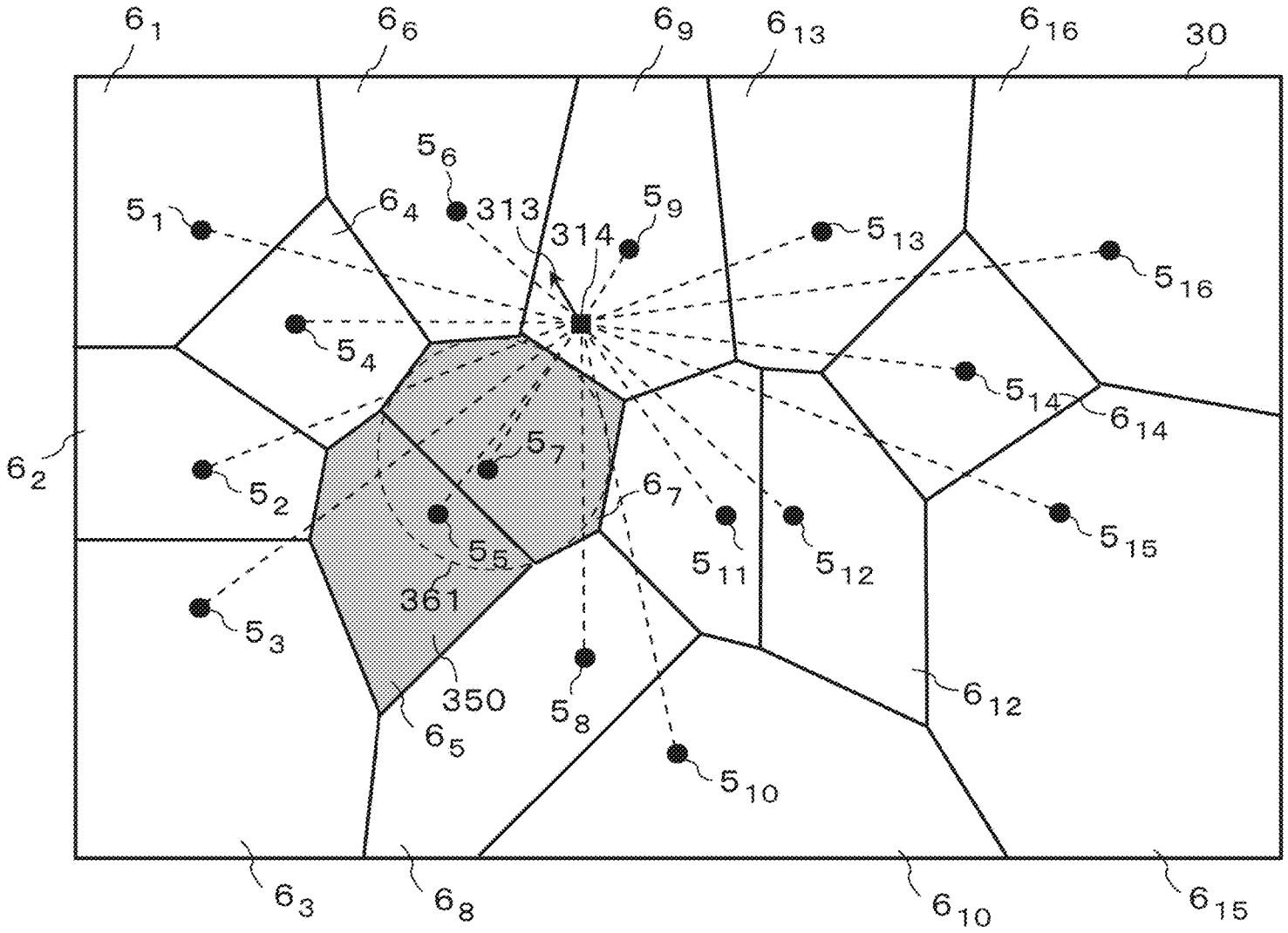
FIG. 19 is a schematic view of area division in the signal processing system.

At S4 described in FIG. 14, the area division processing unit 14 may detect the objects having a directional interval equal to or less than a threshold with respect to the virtual listening position (the angle formed with the closest direction) and integrate the divided areas corresponding to these objects. That is, the area division processing unit 14 may integrate the plurality of divided areas corresponding to the plurality of objects having a directional interval equal to or less than the threshold with respect to the virtual listening position. FIG. 19 illustrates an example in which the divided areas $\mathbf{6}_5$ and $\mathbf{6}_7$ corresponding to the objects $\mathbf{5}_5$ and $\mathbf{5}_7$ and proximate in direction to each other in FIG. 18 are integrated into a divided area 350. Accordingly, the sounds of the objects $\mathbf{5}_5$ and $\mathbf{5}_7$ are collectively acquired in one directivity (sound collection range 361).

The distance between the objects $\mathbf{5}_5$ and $\mathbf{5}_7$ and the distance between the objects $\mathbf{5}_{11}$ and $\mathbf{5}_{12}$ are in the same range but the directional interval with respect to the virtual listening position 314 are different between these objects. Accordingly, in the signal processing system 1, the sounds of the objects $\mathbf{5}_{11}$ and $\mathbf{5}_{12}$ with a directional interval greater than the threshold are separately acquired, and the sounds of the objects $\mathbf{5}_5$ and $\mathbf{5}_7$ with a directional interval less than the threshold are collectively acquired. That is, whether to acquire the sounds of the plurality of objects separately or collectively is controlled depending on the directional interval with respect to the virtual listening position.

Modification Example 2

Figure 20:
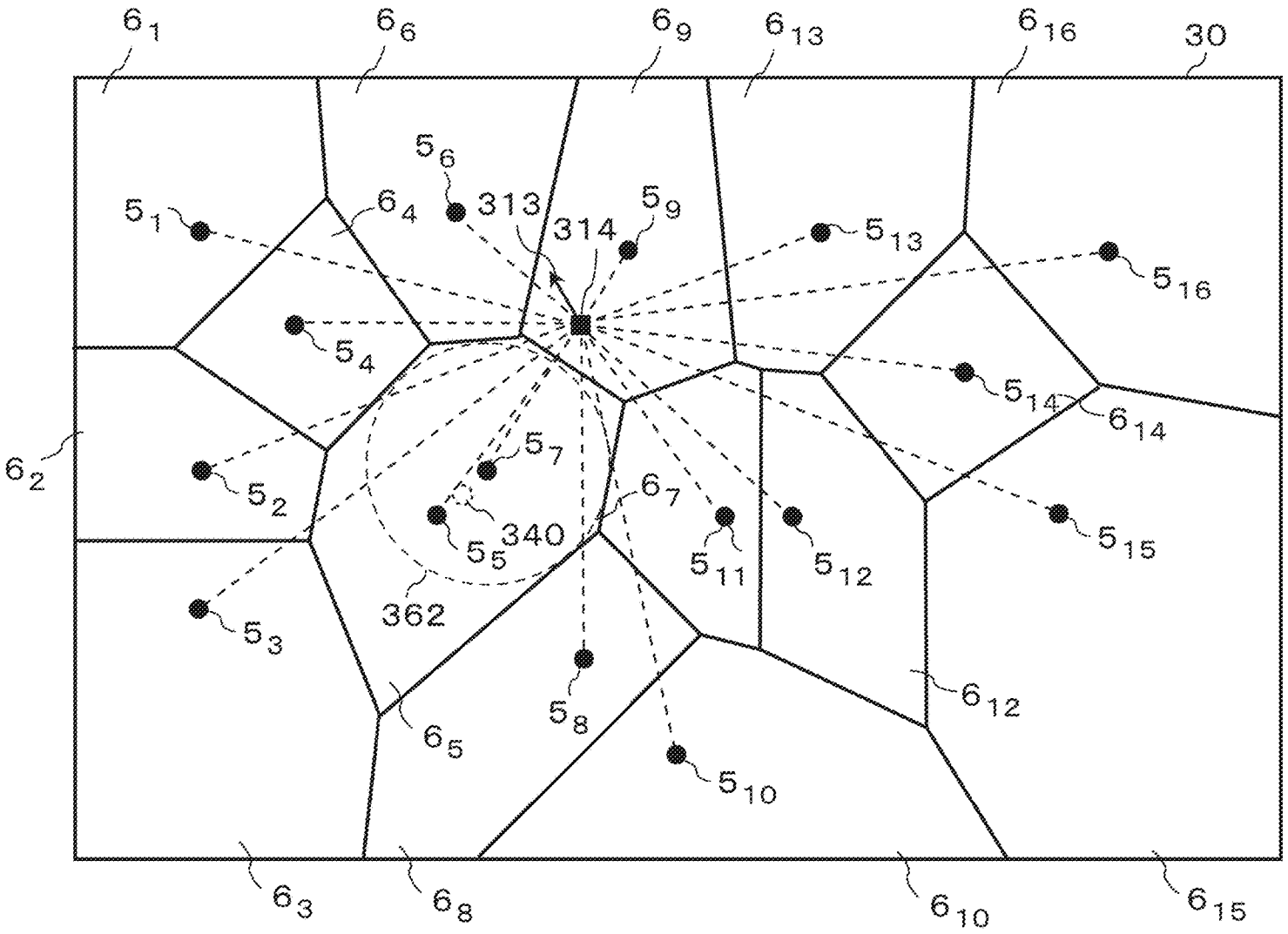
FIG. 20 is a schematic view of area division in the signal processing system.

At S4 described in FIG. 14, the area division processing unit 14 may integrate the objects (generating points) having a directional interval equal to or less than the threshold with respect to the virtual listening position into a centroid position, for example, before performing Voronoi tessellation of the sound collection target area. That is, the area division processing unit 14 integrates the positions of the plurality of objects having a directional interval equal to or less than the threshold with respect to the virtual listening position. FIG. 20 illustrates an example in which the generating points $\mathbf{5}_5$ and $\mathbf{5}_7$ proximate in direction in FIG. 18 are integrated into a generating point 340, and the sounds of the objects $\mathbf{5}_5$ and $\mathbf{5}_7$ are collectively acquired in one directivity (sound collection range 362).

The sound collection range 361 illustrated in FIG. 19 and the sound collection range 362 illustrated in FIG. 20 are determined depending on the directivity determined by the first method at S6 described in FIG. 14 under an additional condition that all the plurality of objects whose sounds are to be collectively acquired is included in the sound collection range. As a matter of course, the directivity may be determined by the second method, for example. In that case, the oriented direction is fixed to the integrated generating point 340 illustrated in FIG. 20, for example.

Another Modification Example

Considering that the resolution of a human's directional sense to a sound source is high on the front and rear sides and is low on the lateral sides, the area division processing unit 14 may change the threshold of the directional interval depending on the direction with respect to the virtual listening direction 313. Specifically, the area division processing unit 14 decreases the threshold in the neighborhood of the virtual listening direction and the opposite direction, and acquires (plays back) separately the sounds of the plurality of objects proximate in direction. Meanwhile, the area division processing unit 14 increases the threshold in the lateral directions with respect to the virtual listening direction, and acquires (plays back) collectively the sounds of the plurality of objects proximate in direction.

Since the amount of processing in signal generation and playback increases as the number D of the divided areas is larger, the real-time process may not be in time depending on the value of D. Meanwhile, as the threshold of the directional interval is larger, the divided areas and the generating points are more likely to be integrated and thus the number D of the divided areas becomes small.

The area division processing unit 14 may control the threshold to be $D \leq D_{max}$ by setting the upper limit number $D_{max}$ of the divided areas according to the allowable amount of processing by the signal processing system 1. This makes it possible to ensure the real-time characteristic by reducing the spatial resolution with a limit on the amount of processing.

With a lower frequency, the formable directivity is looser and the area of the sound collection range is larger and may not adapt to the divided area. Meanwhile, with the greater threshold of the directional interval, the number D of the divided areas becomes smaller and the divided area tends to be larger.

Accordingly, process at S4 may be performed in a frequency loop such that the threshold is larger at low frequencies than at high frequencies to increase the divided areas in size. Accordingly, the area division is controlled depending on the frequency, and the sound collection ranges can adapt to the divided areas. In addition, the number of the divided areas is D(f) depending on the frequency, and the number of virtual speakers is controlled by frequency at S8, for example.

In addition, the directional interval between the objects depends on the virtual listening position, and the virtual listening position may be determined such that the minimum value of the directional interval is greater than a predetermined value to allow the sounds of the objects to be heard from different directions as much as possible.

Based on simply the distance between the objects (generating points) not depending on the virtual listening position, instead of the directional interval with respect to the virtual listening position, the generating points at a short distance from each other (the distance is shorter than a threshold) may be integrated by clustering or the like. That is, the area division processing unit 14 integrates the positions of the plurality of objects based on the distance between the objects. In this case, the divided areas are integrated according to the integration of the generating points and the positions of the plurality of objects are included in the integrated divided areas.

The display processing unit 16 may generate the indications as illustrated in FIGS. 17 to 20 and display the same on the display unit 15. That is, the display processing unit 16 displays at least one of the status of the divided areas and the sound collection ranges. According to the user operation input on the display unit 15 detected by the operation detection unit 17, the area division processing unit 14 may control the area division or the geometric processing unit 13 and the signal analysis processing unit 12 may cooperate to control the directivity.

For example, when the user drags as shown by an arrow 371 crossing over an image of a boundary 353 between the divided areas $\mathbf{6}_5$ and $\mathbf{6}_7$ illustrated in FIG. 18, the operation detection unit 17 may detect this operation and integrate the divided areas $\mathbf{6}_5$ and $\mathbf{6}_7$ sharing the boundary 353 into the divided area 350 illustrated in FIG. 19. Alternatively, when the user touches and selects in sequence the images of the plurality of divided areas $\mathbf{6}_5$ and $\mathbf{6}_7$ illustrated in FIG. 18, the operation detection unit 17 detects this operation and the display processing unit 16 displays a button 372. When the user touches the button 372, the area division processing unit 14 may integrate the selected divided areas $\mathbf{6}_5$ and $\mathbf{6}_7$ into the divided area 350 illustrated in FIG. 19. That is, at least either the status of the divided areas or the sound collection ranges is adjusted.

Further, at S6 described in FIG. 14, the oriented direction and sharpness of the directivity may be controlled. Specifically, the user drags the boundary 334 between the sound collection ranges illustrated in FIG. 17 as shown by a bidirectional arrow 373, and the area division processing unit 14 detects this operation via the operation detection unit 17 and changes the sound collection ranges. Accordingly, the area division processing unit 14 may control the oriented direction and sharpness of the directivity to obtain an intermediate sound collection range between the sound collection range 334 determined by the second method and the sound collection range 333 determined by the first method, for example.

The playback unit 18 may be formed from a speaker. The signal analysis processing unit 12 may generate speaker playback signals by a publicly known punning process to generate the sound images of the divided area sounds (object sounds) in the respective directions of the objects.

According to the embodiment described above, it is possible to acquire the sounds of the plurality of objects in an appropriate manner regardless of the positions of the objects.

Another Embodiment

The aspect of the disclosure can also be implemented by supplying programs for performing one or more functions in the foregoing embodiments to a system or an apparatus via a network or a storage medium, and reading and executing the programs by one or more processors in a computer in the system or the apparatus. In addition, the aspect of the embodiments can also be implemented by a circuit performing one or more functions (for example, ASIC).

According to the foregoing embodiments, it is possible to enhance the efficiency of processing in a configuration in which sounds are acquired from a plurality of areas obtained by dividing a space to generate playback signals.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-208845, filed Oct. 25, 2016, and 2016-213524, filed Oct. 31, 2016, which are hereby incorporated by reference herein in their entirety.

What is claimed is:

1. A signal processing apparatus comprising:

one or more hardware processors; and one or more memories which stores instructions executable by the one or more hardware processors to cause the signal processing apparatus to perform at least:

acquiring collected sound signals based on collection of sounds in a sound collection region by a plurality of microphones;

determining, based on one or more positions of objects detected in the sound collection region, at positions and sizes of a plurality of partial areas in the sound collection region;

extracting, from the collected sound signals, a plurality of audio signals respectively corresponding to the plurality of determined partial areas; and generating, by sound processing using more than one of the plurality of extracted audio signals, a playback audio signal according to position and orientation of a designated virtual listening point.

2. The signal processing apparatus according to claim 1, wherein number of the plurality of partial areas is determined based on the one or more positions of objects.

3. The signal processing apparatus according to claim 1, wherein sizes of the plurality of partial areas are determined such that a size of a partial area including a position of an object is smaller than a size of a partial area not including a position of an object.

4. The signal processing apparatus according to claim 1, wherein number of the plurality of partial areas is determined based on a processing load relating to generation of the audio signals.

5. The signal processing apparatus according to claim 1, wherein the instructions further cause the signal processing apparatus to perform:

detecting the one or more positions of objects based on a collected sound signal.

6. The signal processing apparatus according to claim 1, wherein the instructions further cause the signal processing apparatus to perform:

acquiring an image based on image capturing for at least a part of the sound collection region;

detecting the one or more positions of objects based on the acquired image.

7. The signal processing apparatus according to claim 1, wherein the generating includes compositing more than one of the plurality of extracted audio signals based on the position and orientation of the virtual listening point.

8. The signal processing apparatus according to claim 1, wherein the plurality of partial areas is determined such that each of the plurality of partial areas is included in a different divided area of a plurality of divided areas obtained by dividing the sound collection region.

9. The signal processing apparatus according to claim 8, wherein each of the plurality of partial areas includes a position of an object, and wherein a sound outside a partial region included in an extracted audio signal corresponding to the partial region is more suppressed than a sound within the partial region included in the extracted audio signal.

10. The signal processing apparatus according to claim 8, wherein the plurality of partial areas is determined set such that at least a part of outer edge of each of the plurality of partial areas is in contact with a boundary between the divided areas.

11. The signal processing apparatus according to claim 8, wherein the plurality of divided areas is obtained by subjecting the sound collection region to Voronoi tessellation with positions of a plurality of objects as generating points.

12. The signal processing apparatus according to claim 8, wherein the plurality of divided areas is obtained by dividing the sound collection region such that size of each of the plurality of partial areas is equal to or greater than a predetermined value.

13. The signal processing apparatus according to claim 8, wherein in a case where a distance between a first object and a second object in the sound collection region is less than a threshold, at least one of the plurality of divided areas includes both the position of the first object and the position of the second object.

14. The signal processing apparatus according to claim 13, wherein the threshold is determined based on at least one of position or orientation of a virtual listening point specified in the sound collection region.

15. The signal processing apparatus according to claim 8, wherein in a case where a partial region of a predetermined size centered on a position of an object cannot be set within a single divided area, a partial region not centered on the position of the object is set.

16. A signal processing apparatus comprising:

one or more hardware processors; and one or more memories which stores instructions executable by one or more hardware processors to cause the signal processing apparatus to perform at least:

acquiring collected sound signals based on collection of of sounds in a sound collection region by a plurality of microphones;

determining, based on at least one of position and orientation of a designated virtual listening point, positions and sizes of a plurality of partial areas in the sound collection region;

extracting, from the collected sound signals, a plurality of audio signals respectively corresponding to the plurality of determined partial areas; and generating, by sound processing using more than one of the plurality of extracted audio signals, a playback audio signal according to the position and orientation of the virtual listening point.

17. The signal processing apparatus according to claim 16, wherein sizes of the plurality of partial areas are determined such that a size of a partial area including the position of the virtual listening point is smaller than a size of a partial area not including the position of the virtual listening point.

18. A signal processing method comprising:

acquiring collected sound signals based on collection of sounds in a sound collection region by a plurality of microphones;

determining, based on one or more positions of objects detected in the sound collection region, positions and sizes of a plurality of partial areas in the sound collection region;

extracting, from the collected sound signals, a plurality of audio signals respectively corresponding to the plurality of determined partial areas; and generating, by sound processing using more than one of the plurality of extracted audio signals, a playback audio signal according to position and orientation of a designated virtual listening point.

19. The signal processing method according to claim 18, wherein number of the plurality of partial areas is determined based on the one or more positions of object.

20. A signal processing method comprising:

acquiring collected sound signals based on collection of sounds in a sound collection region by a plurality of microphones;

determining, based on at least one of position and orientation of a designated virtual listening point, positions and sizes of a plurality of partial areas in the sound collection region;

extracting, from the collected sound signals, a plurality of audio signals respectively corresponding to the plurality of determined partial areas; and generating, by sound processing using more than one of the plurality of extracted audio signals, a playback audio signal according to the position and orientation of the virtual listening point.

21. A non-transitory storage medium storing a program for causing a computer to execute a signal processing method, the signal processing method comprising:

acquiring collected sound signals based on collection of sounds in a sound collection region by a plurality of microphones;

determining, based on one or more positions of objects detected in the sound collection region, positions and sizes of a plurality of partial areas in the sound collection region;

extracting, from the collected sound signals, a plurality of audio signals respectively corresponding to the plurality of determined partial areas; and generating, by sound processing using more than one of the plurality of extracted audio signals, a playback audio signal according to position and orientation of a designated virtual listening point.

* * * * *